US009951499B2

(12) United States Patent
Simpson et al.

(10) Patent No.: US 9,951,499 B2
(45) Date of Patent: Apr. 24, 2018

(54) RETAINER SYSTEMS

(71) Applicant: Simco Mining Products & Services Pty Ltd, Mackay (QLD) (AU)

(72) Inventors: Martin Charles Simpson, MacKay (AU); Oswald Dannhauser Zaayman, Louisville, CO (US)

(73) Assignee: SIMCO MINING PRODUCTS & SERVICES PTY LTD, Mackay (QLD) (AU)

( * ) Notice: Subject to any disclaimer, the term of this patent is extended or adjusted under 35 U.S.C. 154(b) by 42 days.

(21) Appl. No.: 14/368,104

(22) PCT Filed: Dec. 19, 2012

(86) PCT No.: PCT/AU2012/001560
§ 371 (c)(1),
(2) Date: Jun. 23, 2014

(87) PCT Pub. No.: WO2013/090996
PCT Pub. Date: Jun. 27, 2013

(65) Prior Publication Data

US 2015/0007464 A1 Jan. 8, 2015

(30) Foreign Application Priority Data

Dec. 21, 2011 (AU) ..... 2011905337

(51) Int. Cl.
*E02F 9/28* (2006.01)

(52) U.S. Cl.
CPC ..... *E02F 9/2825* (2013.01); *E02F 9/2833* (2013.01); *E02F 9/2841* (2013.01); *E02F 9/2883* (2013.01)

(58) Field of Classification Search
CPC ..... E05C 19/009; E05C 19/04; E05B 15/006; E05B 17/2011; E05B 53/006; E05B 63/121; E02F 9/2833; E02F 9/2841; E02F 9/2883

(Continued)

(56) References Cited

U.S. PATENT DOCUMENTS 3,197,894 A * 8/1965 Ratkowski ..... E02F 9/2841 172/762
4,049,313 A * 9/1977 Lundberg ..... E05B 67/365 292/252

(Continued)

FOREIGN PATENT DOCUMENTS

| | | |
|---|---|---|
| AU | 2005 203717 | 3/2006 |
| CA | 2358932 | 4/2002 |
| WO | WO 2011/069183 | 6/2011 |

*Primary Examiner* — Matthew D. Troutman
(74) *Attorney, Agent, or Firm* — Abelman, Frayne & Schwab

(57) ABSTRACT

A wear part for earthmoving and mining equipment, the wear part having a mounting portion for engaging with a mount such as a nose mount or adaptor, a cheek plate, a boot, a cable hitch or the like provided on or by a bucket, the wear part having a cavity in the mounting portion defined at least in part by an outer wall having an inner face and an outer face, at least one passage formed through said outer wall and opening at one end to the inner face of said outer wall and at the other end to the outer face, and a retainer in said at least one passage and adapted to be selectively engaged with the mount to which the wear part is to be mounted, said outer wall including stop means engaged by said retainer and arranged to stop said retainer escaping from said at least on passage via the outer face end of said passage.

7 Claims, 32 Drawing Sheets

(58) Field of Classification Search
USPC ..... 292/252, 9, 12, 23, 57
See application file for complete search history.

(56) References Cited

U.S. PATENT DOCUMENTS

| | | | | |
|---|---|---|---|---|
| 6,959,506 | B2 * | 11/2005 | Adamic | E02F 9/2825 172/753 |
| 7,640,684 | B2 * | 1/2010 | Adamic | E02F 9/2825 172/753 |
| 8,720,874 | B2 * | 5/2014 | Tschida | F16B 19/109 269/229 |
| 2002/0000053 | A1 | 1/2002 | Adamic et al. | |
| 2002/0023375 | A1 * | 2/2002 | Pippins | E02F 9/2833 37/457 |
| 2006/0078373 | A1 * | 4/2006 | Dingwall | E02F 9/2825 403/315 |
| 2006/0127239 | A1 * | 6/2006 | Adamic | E02F 9/2825 417/360 |
| 2009/0196683 | A1 | 8/2009 | Lunn et al. | |
| 2010/0162594 | A1 * | 7/2010 | Bierwith | F16B 33/02 37/450 |
| 2011/0194912 | A1 * | 8/2011 | Dingwall | E02F 9/2825 411/351 |
| 2012/0055052 | A1 * | 3/2012 | Campomanes | E02F 9/2825 37/456 |
| 2014/0366409 | A1 * | 12/2014 | Simpson | E02F 9/2825 37/456 |
| 2015/0368884 | A1 * | 12/2015 | Cheyne | E02F 9/2841 37/453 |

* cited by examiner

RETAINER SYSTEMS

BACKGROUND OF THE INVENTION

This invention relates to retainer systems for wear parts including ground engaging tools and other wear parts and components of earthmoving and mining equipment. The invention has particular application to wear parts for excavator buckets and dragline buckets and the invention will be described with particular reference to such application. However, the invention also has application to wear parts for other types of equipment, for example, shovel buckets, bucket loaders, bulldozer blades, drotts, bobcats, and backhoes. The invention also has application to retainer systems for load bearing pins such as trunnion pins, anchor pins and the like, especially pins which are subject to significant wear and have to be replaced fairly often but it may also have application to other types of wear parts or pins which have to be reliably secured or locked in a working position. In this specification, the term "wear parts" generally includes nose mounts, teeth and adaptors, for mounting the teeth to the nose mounts, lips and lip shrouds, wing shrouds, drag hitch protectors, anchor brackets and pins, drag pins and socket brackets, trunnion brackets and pins and similar wear parts even though the invention will be described with particular reference to nose mounts, teeth and adaptors.

Typically, excavator buckets, dragline buckets and the like have a base or floor with a cutting edge or lip to which ground engaging tools are fitted to engage the ground or spoil which is to be excavated or loaded as the case may be and to protect the lip from wear. The ground engaging tools which are generally subject to the greatest wear are the teeth and a number of parts are associated with the teeth. The first component, often called the nose or nose mount, is usually fixed in a permanent or semi-permanent manner to the base of the bucket or the lip by welding and protrudes forward from the lip. The second component is releasably mounted on or to the nose so that it can be replaced when it reaches a predetermined wear condition. In some types of equipment the second component is the cutting tip, tooth, or tooth point which engages the ground at its front edge and suffers the main wear while in other equipment, the second component is an adaptor to which a third component being the cutting tip or tooth is releasably fitted which in turn suffers the main wear while the adaptor suffers lesser wear. Thus, it will be understood that while the teeth in a three component system will have a much shorter life than the adaptors, the adaptors themselves do eventually wear out and have to be replaced. Even the nose may wear out long before the bucket floor and walls and will have to be replaced but in the case of the noses, they can be cut away from the base and be replaced by new noses which can be welded to the base but that requires substantial downtime for a fairly substantial operation. In the case of a two component system, while the releasable teeth can be replaced relatively easily, if the nose wears out, a fairly substantial operation is required to replace them as with a three component system.

Typically, the nose includes a forwardly extending protuberance which is adapted to engage in a complementary cavity provided in the tooth, or the adaptor in a three component system. In a two component system, the adaptor has a cavity opening at one end in which the complementary protuberance on the nose engages and a protuberance at the other end which is adapted to engage in the complementary tooth cavity. The two components are commonly releasably secured together by one or more locking pins which lock the tooth and the underlying adaptor together or the adaptor and the underlying nose in the case of a three component system. There are various securing systems available which are commonly referred to as retaining systems.

In one known retainer system, a tapered pin is driven through aligned holes or passages extending through the tooth and the adaptor from top to bottom or the adaptor and the nose. However, the passage causes a weakness in the nose or the adaptor (in a three component system) which can lead to failure. In another case, two opposed relatively short locking pins located in the nose are arranged to be extended into complementary passages or openings in the opposed side walls of the tooth or adaptor which is mounted on the nose.

It will be appreciated that the cavities and protuberances are shaped to inhibit relative movement between the engaging components when in operation, although the presently known systems do not inhibit relative movement as well as desired. Further, the presently available retaining systems do not provide the reliability or efficiency of operation desired.

While teeth and adaptors are subject to more wear than other components and consequently will likely benefit from the present invention more than other wear parts, there are other wear parts which do require replacement throughout the life of a bucket, for example, wing shrouds, drag hitch protectors, anchor brackets and pins, drag pins and socket brackets, trunnion brackets and pins, and such components will also likely benefit from the present invention. Some such components may not be commonly referred to as wear parts in mining and earthmoving industries but in this specification, such components are considered to be "wear parts".

BRIEF SUMMARY OF THE INVENTION

With the foregoing in view, the invention resides broadly in a wear part for earthmoving and mining equipment, the wear part having a mounting portion for engaging with a mount such as a nose mount or adaptor, a cheek plate, a boot, a cable hitch or the like provided by the bucket, the wear part having a cavity in the mounting portion defined at least in part by an outer wall having an inner face and an outer face, at least one passage formed through said outer wall and opening at one end to the inner face of said outer wall and at the other end to the outer face, and a retainer in said at least one passage and adapted to be selectively engaged with the mount to which the wear part is to be mounted, said outer wall including stop means engaged by said retainer and arranged to stop said retainer escaping from said at least one passage via the outer face end of said passage.

In another aspect, the invention resides broadly in a wear part for earthmoving and mining equipment, the wear part having a mounting portion for engaging with a mount such as a nose mount or adaptor, a cheek plate, a boot, a cable hitch or the like provided by or on a bucket, the wear part having a cavity in the mounting portion defined at least in part by an outer wall having an inner face and an outer face, at least one passage formed through said outer wall and opening at one end to the inner face of said outer wall and at the other end to the outer face, said outer wall including stop means adapted to be engaged by a complementary retainer in said passage to stop such retainer escaping from said passage via the outer face end of said passage.

In one form of the invention, the wear part is a tooth for earthmoving and mining equipment, the tooth having a cutting tip at its front and a mounting portion rearward of the cutting tip and the cavity is provided in the mounting portion for engaging with the mount. In such form, the mount is either a nose mount connected to the lip of a bucket or an adaptor connected to the nose mount which in turn is connected to the lip of a bucket. In another form, the wear part is an adaptor for earthmoving and mining equipment, the adaptor having a protuberance at its front for mounting a tooth thereon and a mounting portion rearward of the protuberance and wherein said cavity is provided in the mounting portion and opening to the rear for engaging with the mount.

In either case, the passage through the outer wall of the mounting portion of the tooth or adaptor is aligned with the hole in the protuberance of the nose mount or adaptor as the case may be when the protuberance engages in the cavity. The retainer being fitted in its passage of the tooth or adaptor, can then be actuated to drive the shaft into the hole in the mount. In such case, the stop means is engaged by the retainer to stop the retainer escaping from the passage and to provide an abutment against which the retainer housing bears upon the shaft being rotated and thereby being forced into the hole in the mount. In a preferred form, there are at least two opposed retainers for each wear part and two opposed holes in the mount for receiving the respective retainer shafts.

The invention resides broadly in other wear parts, for example, where the wear part is a wing shroud or a hitch protector.

In another aspect the invention resides broadly in a retainer for retaining a wear part on a mount, the retainer being adapted to be mounted in the wear part and to be actuated to secure the wear part to the mount, the retainer including:

a housing with a bore therethrough having an inner end and an outer end;

a shaft mounted in said bore, said shaft including connection means accessible from the outer end of said housing for connection of a tool thereto for rotating said shaft relative to said housing; and coupling means coupling said shaft to said housing and arranged to cause movement of said shaft along said bore in one direction upon rotation thereof relative to said housing in one direction between a retracted position and an extended position and movement in the opposite direction along said bore upon rotation in the opposite direction between an extended position and a retracted position.

Preferably, the components of the retainer are arranged such that when in the extended position the outer end of the shaft is substantially within the bore of the housing so that when fitted to a wear part such as a tooth or adaptor the shaft is protected by the housing against impact by spoil. It is also preferred that in the retracted position, the inner end of the shaft be substantially within the bore. Advantageously, such arrangement allows the housing to be sized so that the inner end of the housing is flush with the inner face of the wear part cavity to which it is to be fitted.

It is also preferred that the components of the retainer be arranged so that when in the extended position a sufficient portion of the shaft is maintained in the housing in order to transmit any forces applied to the shaft by the housing and in turn the wear part as the case may be. It that respect, it will be appreciated that the purpose of the retainer is to hold the wear part on the mount when not under load especially in the case of a tooth or adaptor. However, it is still preferred that the coupling means be arranged to prevent movement of the shaft beyond a predetermined extended position so that the shaft is sufficiently engaged in the housing to carry any possible loads and also in case the retainer is used to "pull" the wear part onto the mount, as can be done in the case of teeth and adaptors. In one form of the invention, spring loaded locking pins or balls mounted in bores through the housing and arranged to cooperate with complementary dimples in the shaft are used to provide preset retracted and extended positions.

Preferably, the connection means is a hexagonal shaped head similar to a hexagon bolt head adapted to be engaged by a socket spanner. In such form, the bore and the shaft are suitably sized to provide clearance for a socket spanner within the bore. However, other types of connection means such as Allen key heads may be used if desired.

Preferably, the housing has a generally cylindrical outer face with opposed flat land portions across opposite chords of the housing, the lands being adapted to engage with complementary lands provided in the passage in the wear part in which the retainer is to be mounted.

Preferably, the housing includes a spigot portion defining a shoulder adapted to engage with a complementary shoulder provided in the passage in the wear part in which the retainer is to be mounted.

Preferably, the coupling means includes a pair of opposed helical grooves (or channels) formed in the shaft and opening to the outer cylindrical face with complementary pins mounted in the housing and arranged to engage with those grooves or channels to permit the shaft to rotate relative thereto and move longitudinally along the bore between the retracted and extended positions.

Preferably, said stop means in the wear part includes a shoulder formed in said passage adjacent the outer face of the wall and said retainer is arranged to abut said shoulder.

Preferably, said passage and said retainer have complementary shapes adapted to prevent rotation of the retainer within the passage. In a preferred form, the passage is generally cylindrical with opposed flat land portions across opposite chords of the passage and the retainer has a complementary cylindrical shape with complementary opposed flat lands.

In another aspect, the invention resides broadly in a mount for a wear part, the mount including a protuberance adapted to engage in a cavity provided in the wear part to be fitted thereto and the protuberance having at least one hole provided therein for receiving the shaft of a retainer as previously described. In a preferred form, the mount has at least two generally opposed holes for receiving the shafts of opposed retainers.

Advantageously, when the retainer is fitted in the passage, the housing of the retainer is arranged to engage the stop means which provides an abutment adapted to bear the reactive force applied by the retainer as the shaft is forced into the mount by actuation of the retainer as well as forces applied to the shaft during operation of the machine to which the wear part is fitted.

In another aspect, the invention resides broadly in a tooth for earthmoving and mining equipment, the tooth having a cutting tip at its front and a mounting portion rearward of the cutting tip with a cavity therein opening to the rear for engaging with a nose mount connected to the lip of a bucket, the cavity being defined at least in part by an outer wall having an inner face and an outer face, at least one passage formed through said outer wall and opening at one end to the inner face of said wall and at the other end to the outer face, and a retainer in said passage and adapted to be selectively engaged with the nose mount to which the tooth is to be mounted, said wall including stop means engaged by said retainer and arranged to stop said retainer escaping from said passage via the outer face end of said passage.

In another aspect, the invention resides broadly in a tooth for earthmoving and mining equipment, the tooth having a cutting tip at its front and a mounting portion rearward of the cutting tip with a cavity therein opening to the rear for engaging with a nose mount connected to the lip of a bucket, the cavity being defined at least in part by an outer wall having an inner face and an outer face, at least one passage formed through said wall and opening at one end to the inner face of said wall and at the other end to the outer face, said wall including stop means adapted to be engaged by a complementary retainer in said passage to stop such retainer escaping from said passage via the outer face end of said passage.

In another aspect, the invention resides broadly in an adaptor for earthmoving and mining equipment, the adaptor tooth having a protuberance at its front for mounting a tooth thereon and a mounting portion rearward of the protuberance with a cavity therein opening to the rear for engaging with a nose mount connected to the lip of a bucket, the cavity being defined at least in part by an outer wall having an inner face and an outer face, at least one passage formed through said wall and opening at one end to the inner face of said wall and at the other end to the outer face, said wall including stop means engaged by a complementary retainer in said passage and arranged to stop said retainer escaping from said passage via the outer face end of said passage.

In another aspect, the invention resides broadly in an adaptor for earthmoving and mining equipment, the adaptor having a protuberance at its front for mounting a tooth thereon and a mounting portion rearward of the protuberance with a cavity therein opening to the rear for engaging with a nose mount connected to the lip of a bucket, the cavity being defined at least in part by an outer wall having an inner face and an outer face, at least one passage formed through said wall and opening at one end to the inner face of said wall and at the other end to the outer face, said wall including stop means adapted to be engaged by a complementary retainer in said passage to stop said retainer escaping from said passage via the outer face end of said passage.

In still yet another aspect, the invention resides broadly in a wear part for earthmoving and mining equipment, the wear part having a mounting portion for engaging with a pin such as an anchor pin or a drag pin, the wear part having a cavity in the mounting portion defined at least in part by an outer wall having an inner face and an outer face, at least one passage formed through said outer wall and opening at one end to the inner face of said outer wall and at the other end to the outer face, and a retainer in said at least one passage and adapted to be selectively engaged with the pin with which the wear part is to be engaged, said outer wall including stop means engaged by said retainer and arranged to stop said retainer escaping from said at least one passage via the outer face end of said passage.

In still yet another aspect, the invention resides broadly in a wear part for earthmoving and mining equipment, the wear part having a mounting portion for engaging with a pin such as an anchor pin or a drag pin, the wear part having a cavity in the mounting portion defined at least in part by an outer wall having an inner face and an outer face, at least one passage formed through said outer wall and opening at one end to the inner face of said outer wall and at the other end to the outer face, said outer wall including stop means adapted to be engaged by a complementary retainer in said at least one passage to stop the retainer escaping from said at least one passage via the outer face end of said at least one passage. In such form of the invention, the pin may be subject to significantly more wear than the wear part to which it is mounted and consequently it may be replaced along with the retainers without replacing the wear part.

In still yet another aspect, the invention resides broadly in a pin adapted for use with a wear part, the pin including a load bearing shaft and a head, the head being adapted to be received in the cavity of the mounting portion of the wear part and having at least one hole provided therein extending laterally of the axis of the pin for receiving the shaft of a retainer as previously described mounted in the wear part. In a preferred form, the pin head has at least two generally opposed holes for receiving the shafts of opposed retainers.

BRIEF DESCRIPTION OF THE DRAWINGS

In order that the invention may be more clearly understood and put into practice, the invention will now be described with reference to the accompanying drawings wherein.

DETAILED DESCRIPTION OF THE DRAWINGS

Figure 1:
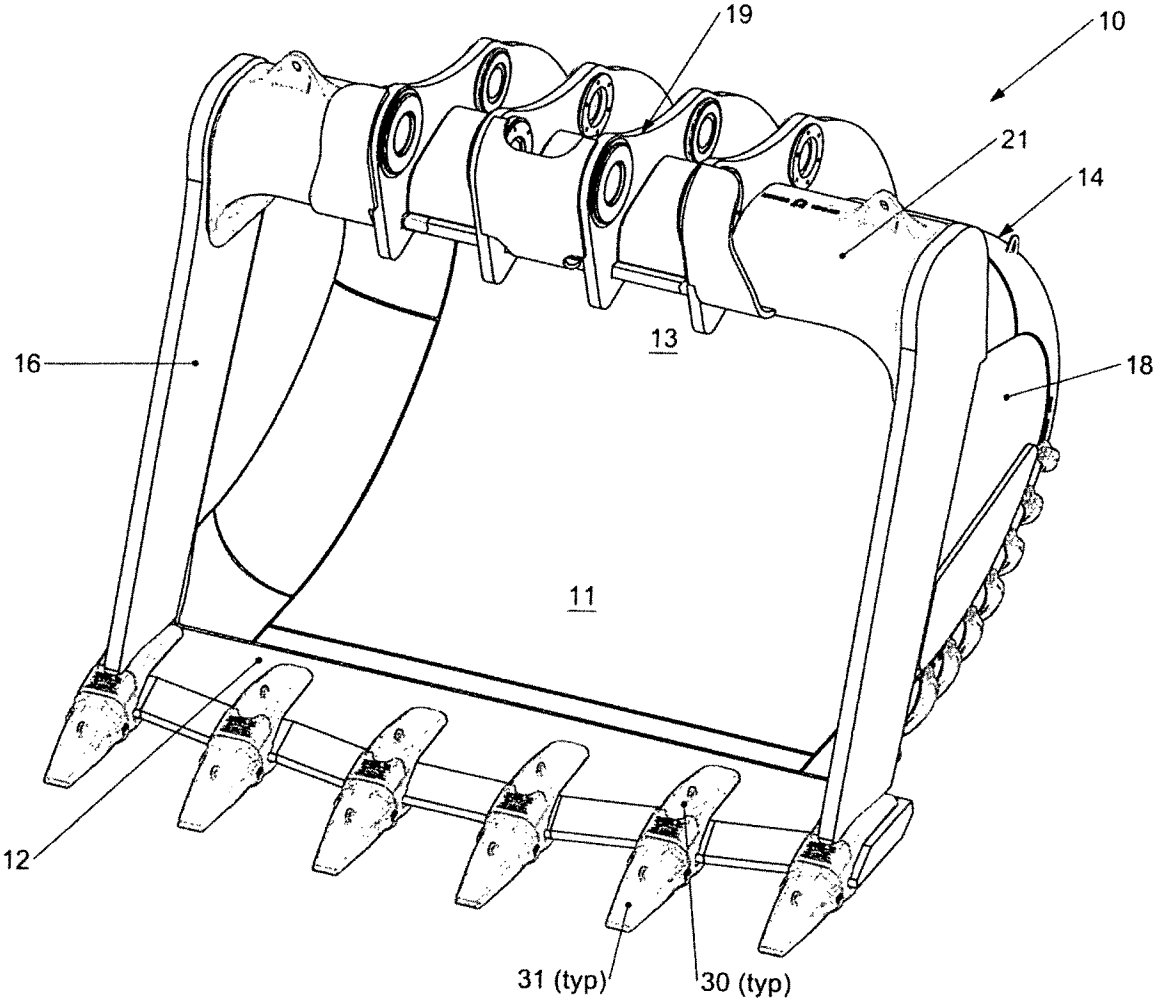
FIG. 1 is a pictorial representation of an excavator bucket from the front with a plurality of teeth mounted on complementary nose mounts at the lip of the bucket.
Figure 2:
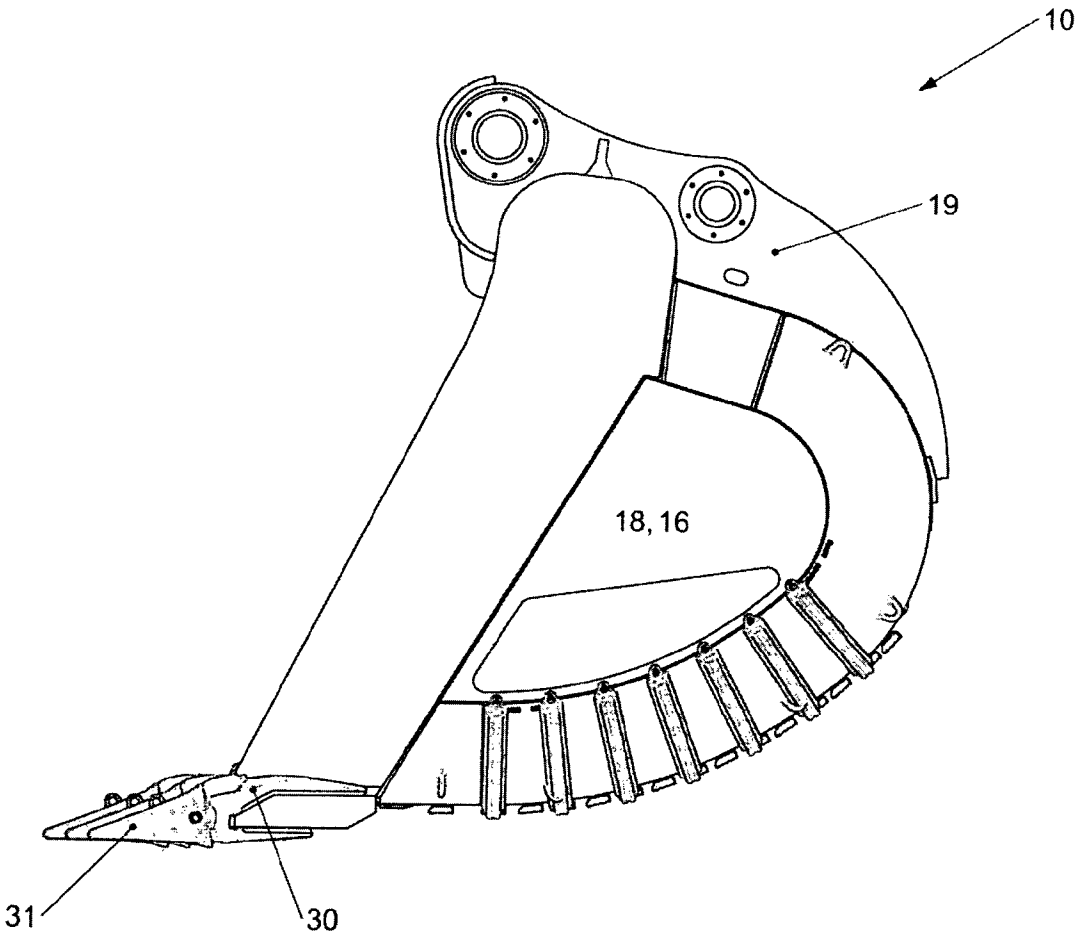
FIG. 2 is pictorial representation of the excavator bucket of FIG. 1 from its right side.
Figure 3:
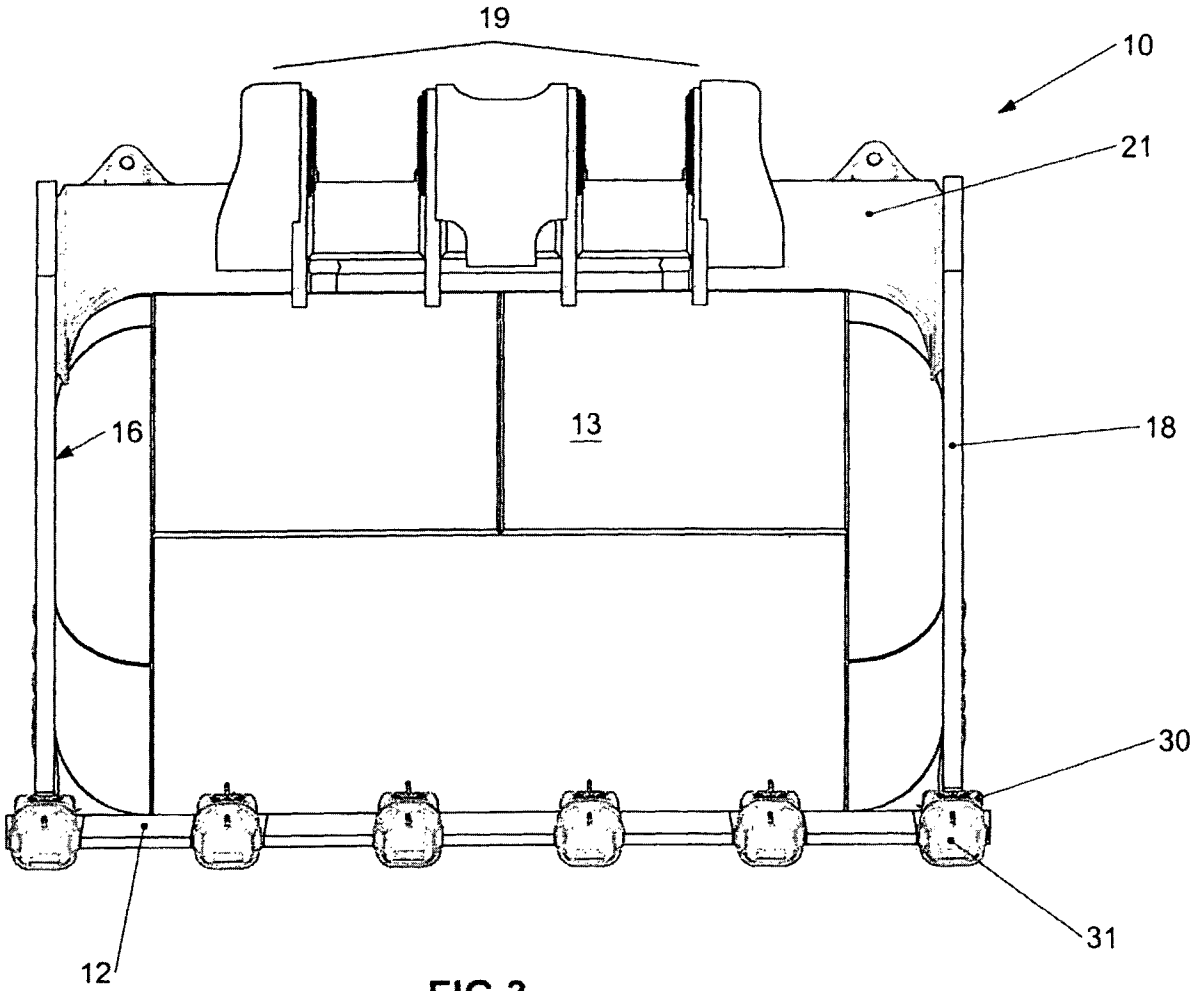
FIG. 3 is a front elevation of the excavator bucket of FIG. 1.

The bucket 10 illustrated in FIG. 1 has a floor 11 with a ground engaging leading edge (or lip) 12 at its front. The floor curves upwardly behind the lip to form a contiguous rear wall 13 which in turn curves upwards and forwards to form a contiguous upper wall 14, the floor, the rear wall and the upper wall forming a generally U-shaped bucket enclosed by opposed generally planar side walls 16 and 18. A curved lifting arch or bar 21 extends across the top of the bucket between the side walls and a plurality of spaced apart lifting lugs 19 are welded to the arch and the upper wall for connection of an excavator lifting arm and crowd arm thereto in known manner.

A plurality of spaced apart nose mounts 30 are welded to the bucket floor 11 across the front and extend forward from the lip 12. The nose mounts described in this embodiment are solid cast iron or cast steel fittings. Teeth 31 are fitted to the nose mounts and secured thereto as will be described in more detail later.

Figure 4:
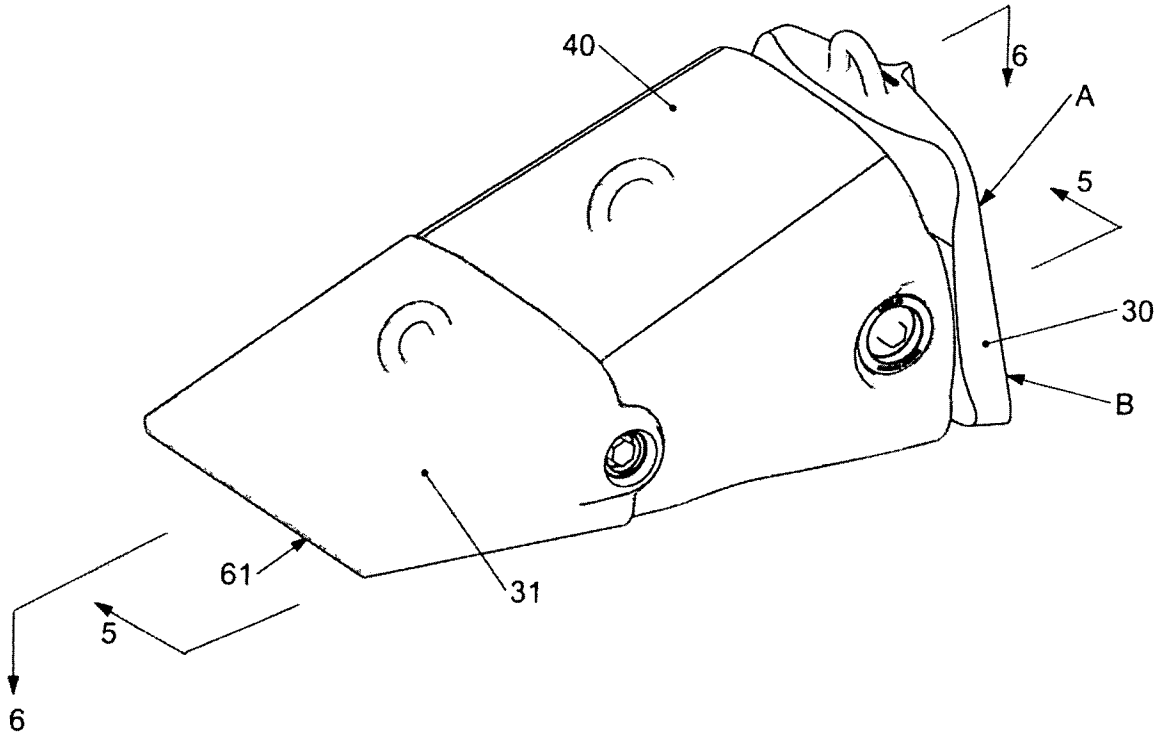
FIG. 4 is pictorial representation of an adaptor according to the invention with a tooth according to the invention mounted thereon, the tooth being adapted to be mounted on the bucket of FIG. 1 or on a bucket having larger nose mounts in combination with the adaptor.
Figure 5:
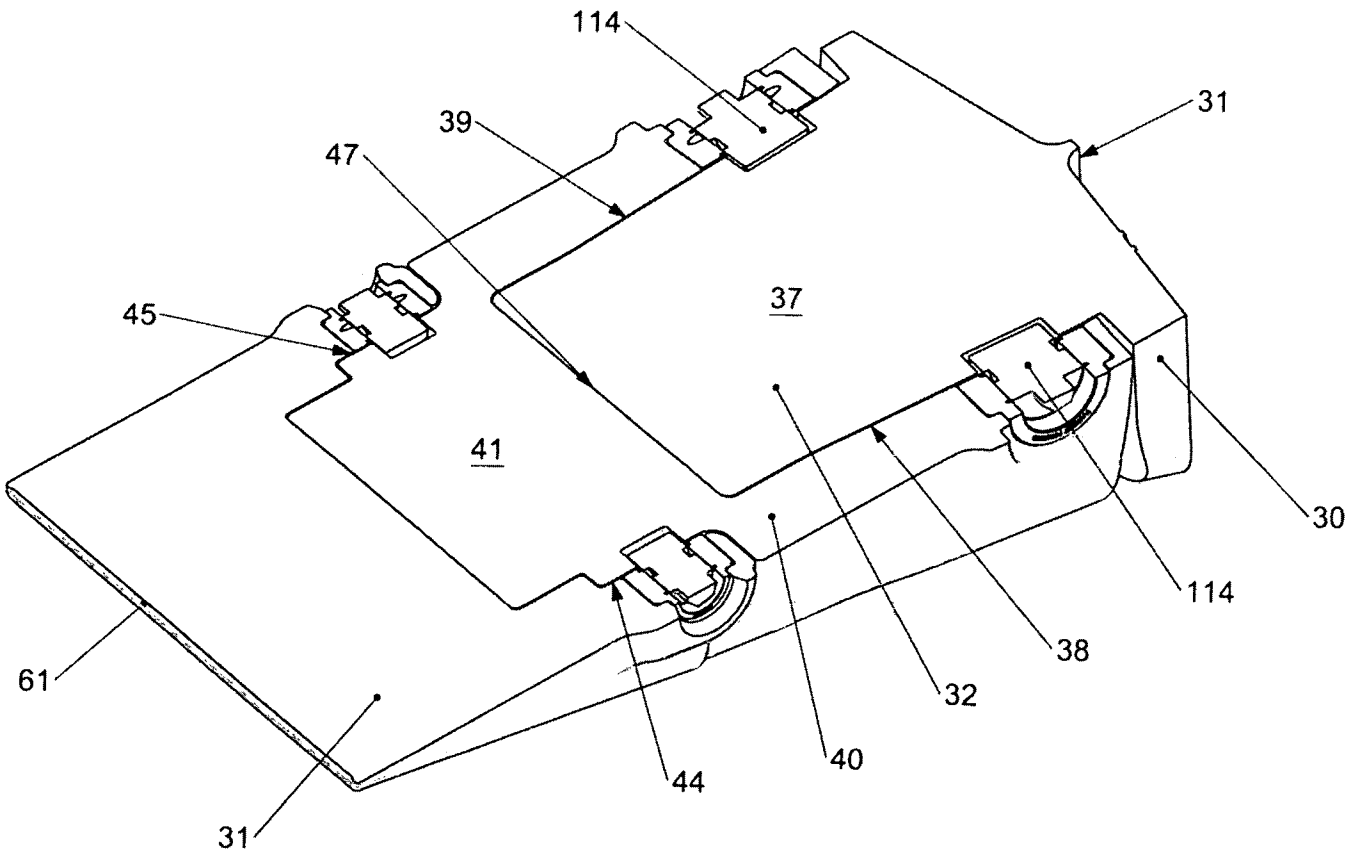
FIG. 5 is sectional pictorial representation of the adaptor and tooth of FIG. 4 along a transverse plane through line 5-5.
Figure 6:
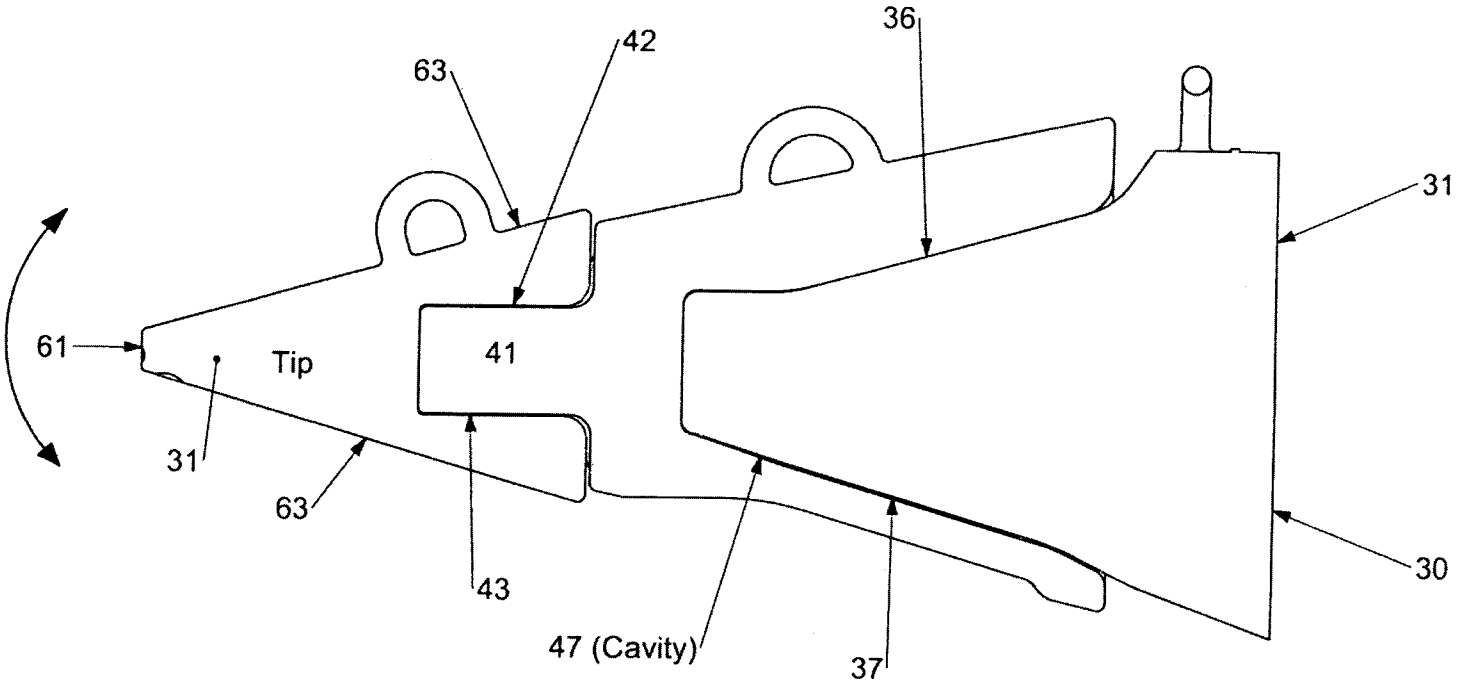
FIG. 6 is sectional pictorial representation of the adaptor and tooth of FIG. 4 along a symmetrical vertical plane through line 6-6.
Figure 7:
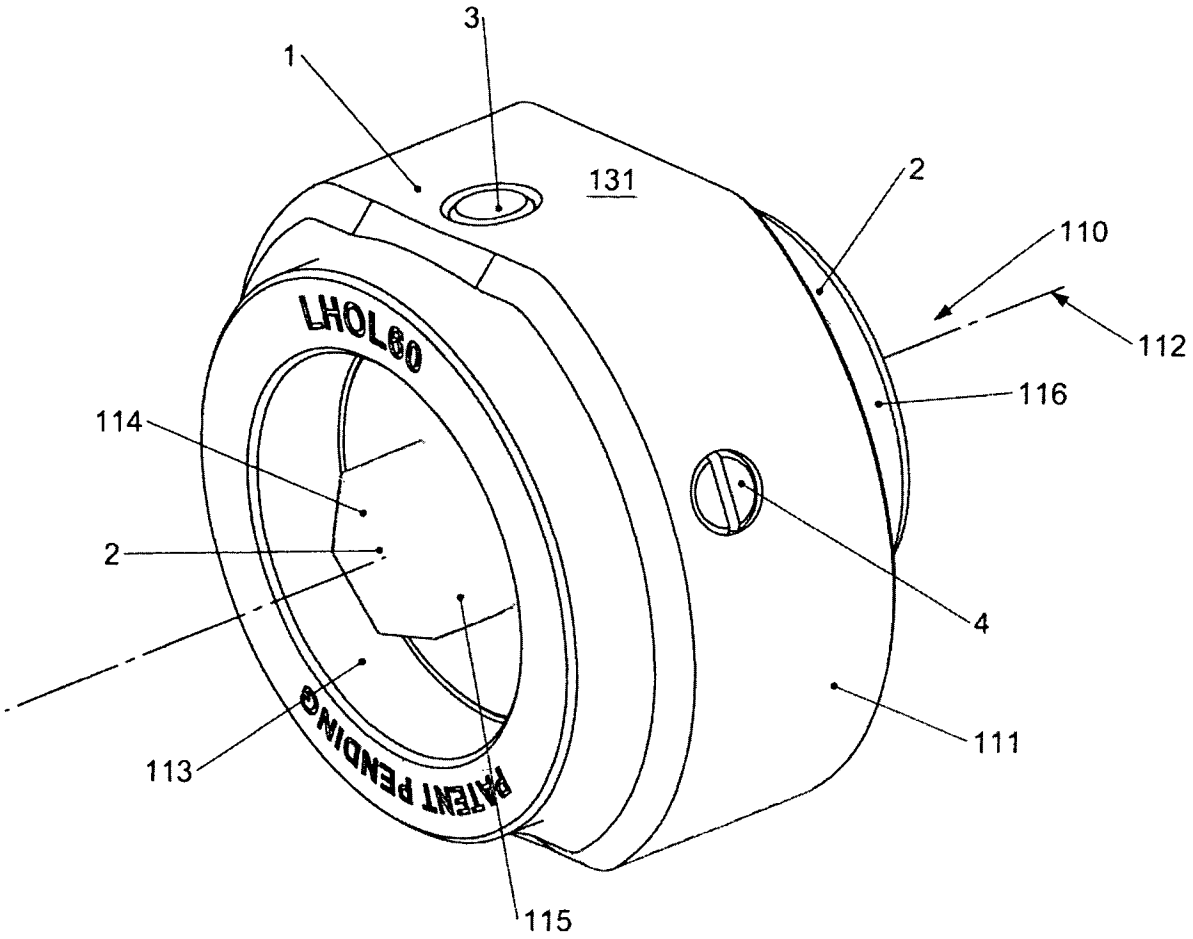
FIG. 7 is a pictorial representation of a retainer according to the invention from one end.
Figure 8:
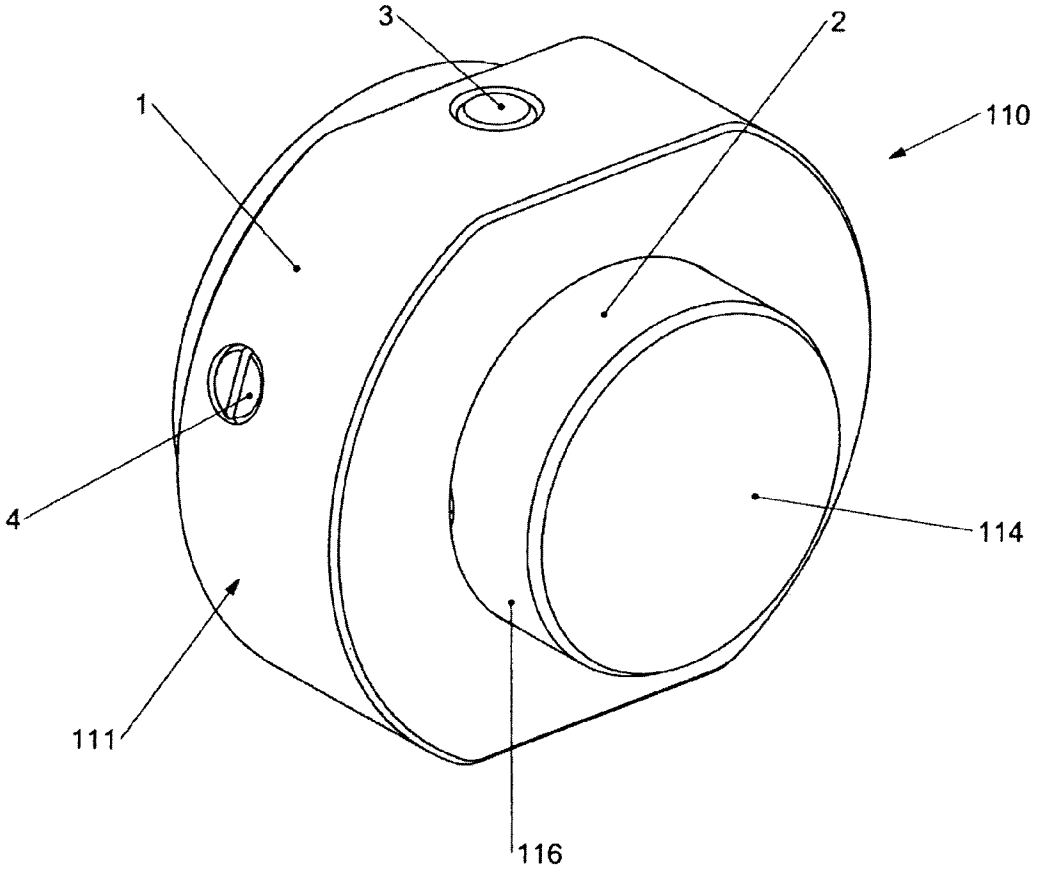
FIG. 8 is a pictorial representation of the retainer of FIG. 7 from the other end.

As can be seen in FIGS. 4, 5 and 6, bigger buckets can be fitted with intermediate adaptors 40 between the teeth and the respective nose mounts. In such cases with the present invention the adaptors are mounted to the nose mounts in the same manner as the teeth would be mounted and in turn, the teeth are mounted to the adaptor in the same manner as they would be mounted to the nose mount. It will be appreciated that in FIGS. 4, 5 and 6, the nose mount 30 is shown cut away at its rear (the lip end) along lines A and B, the portion of the nose mount beyond lines A and B by which it is mounted to the lip of the bucket not being relevant to the present invention. It will also be appreciated that the portion by which it is mounted to the floor of the bucket may have different shapes and arrangements depending on the bucket floor to which the nose mount is to be mounted. In that regard, the present invention relates to the retainer system used to secure the teeth to their respective nose mounts or adaptors or the adaptors to their respective nose mounts.

As can be seen in FIGS. 5 and 6, the nose mount 30 includes a nose base 31 which is suitably formed for being welded to the floor of the bucket adjacent the lip. A protuberance 32 extends forwardly from the nose base and is defined at least in part by opposed upper and lower faces 36 and 37 and opposed side faces 38 and 39.

Similarly, the adaptor 40 has a protuberance 41 at its front defined by opposed upper and lower faces 42 and 43 and opposed side faces 44 and 45 and a mounting portion 46 rearward of the protuberance with a cavity 47 therein adapted to receive the protuberance 32 of the nose mount 30 in a reasonably tight fit, the cavity being defined by the inner faces 51 and 52 of spaced apart opposed upper and lower walls 53 and 54 and the inner faces 56 and 57 of spaced apart opposed side walls 58 and 59 respectively.

The tooth 31 is similar to the adaptor in respect of the cavity although the cavity has a different shape to complement a different shaped protuberance of the adaptor in this case. The tooth has a ground breaking or cutting edge 61 and a rearwardly opening cavity 62 formed in the mounting portion 63 behind the cutting edge in which the protuberance 41 of the adaptor is engaged. The cavity is defined by opposed spaced apart upper and lower walls 64 and 65 with inner faces 66 and 67 respectively and opposed spaced apart side walls 68 and 69 with inner faces 70 and 71 respectively.

Opposed aligned blind passages or holes 81 and 82 having end faces 81*a* and 82*a* respectively extend into the protuberance 32 from the side faces of the adaptor for receiving therein retaining shafts or pins 114 when the adaptor is mounted on a nose mount as will be described later. Similarly, the protuberance of the adaptor has similar blind passages 91 and 92 formed therein for the same purpose when a tooth is mounted thereon. Further, opposed through passages 83 and 84 are provided through the side walls 58 and 59 respectively of the mounting portion of the adaptor for receiving therein retaining devices 110 for securing the adaptor to the nose mount as will be described later. The same type of devices can be mounted in similar through passages in the tooth 31 and operate in the same manner as will now be described with respect to the adaptor.

The retaining device 110 illustrated more clearly in FIGS. 7 to 16 includes two main components, a housing 111 of generally cylindrical shape centred on a longitudinal axis 112 with a bore 113 therethrough and coaxial therewith in which a coaxial pin or shaft 114 is mounted for rotation relative thereto about the longitudinal axis and translation therealong. It can be seen from the relative position of the shaft and the housing in the drawings, that the shaft is able to move from a fully extended position seen in FIG. 7 to a fully retracted position seen in FIG. 10.

The shaft 114 has a hexagon head type end portion 115 at the outer end which is adapted to receive a socket spanner thereon and a cylindrical pin portion 116 at the other end which is adapted to engage in one of the blind passages 81 and 82 in the protuberance 32 of the adaptor.

Figure 9:
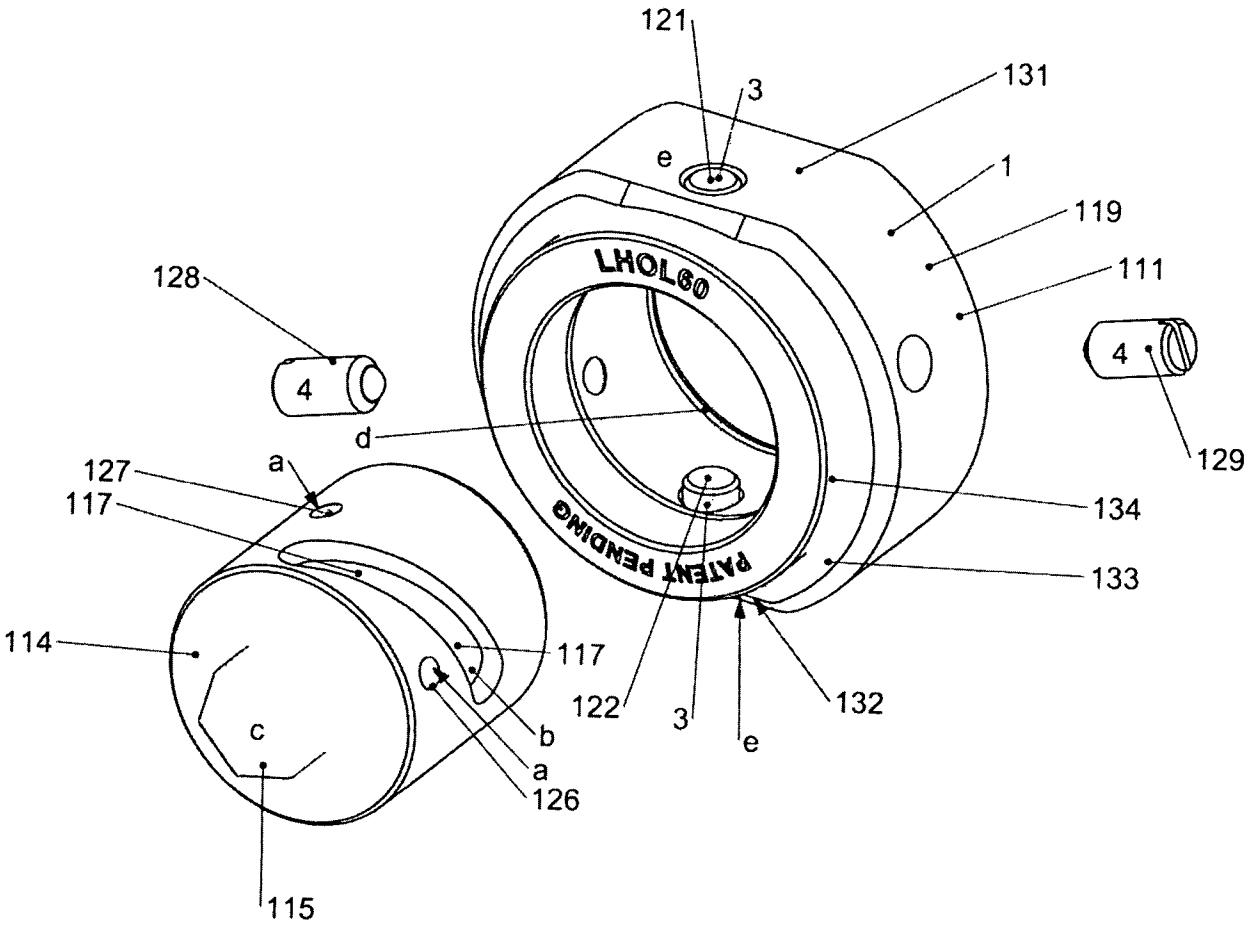
FIG. 9 is a pictorial representation of the retainer of FIG. 7 with most components in line for assembly.
Figure 10:
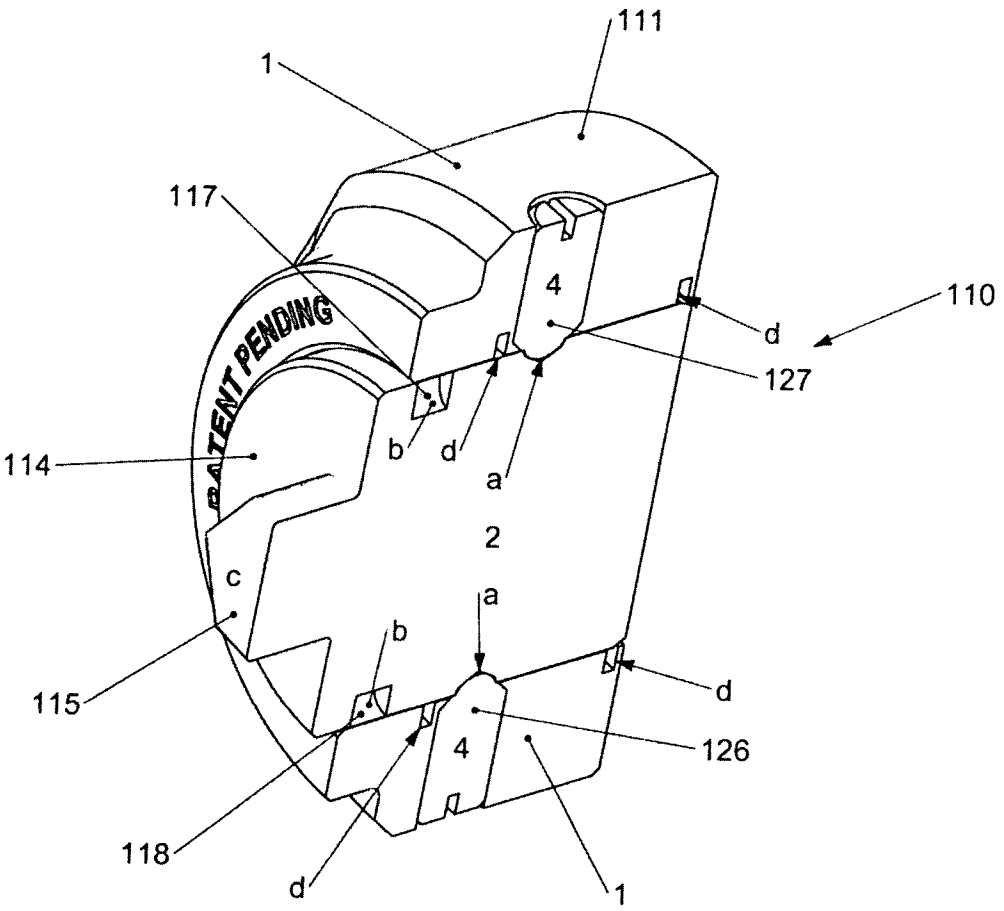
FIG. 10 is a sectional view of the retainer of FIG. 7 along a diametral plane containing the longitudinal axis and passing through the round sides of the retainer housing with the shaft retracted.
Figure 11:
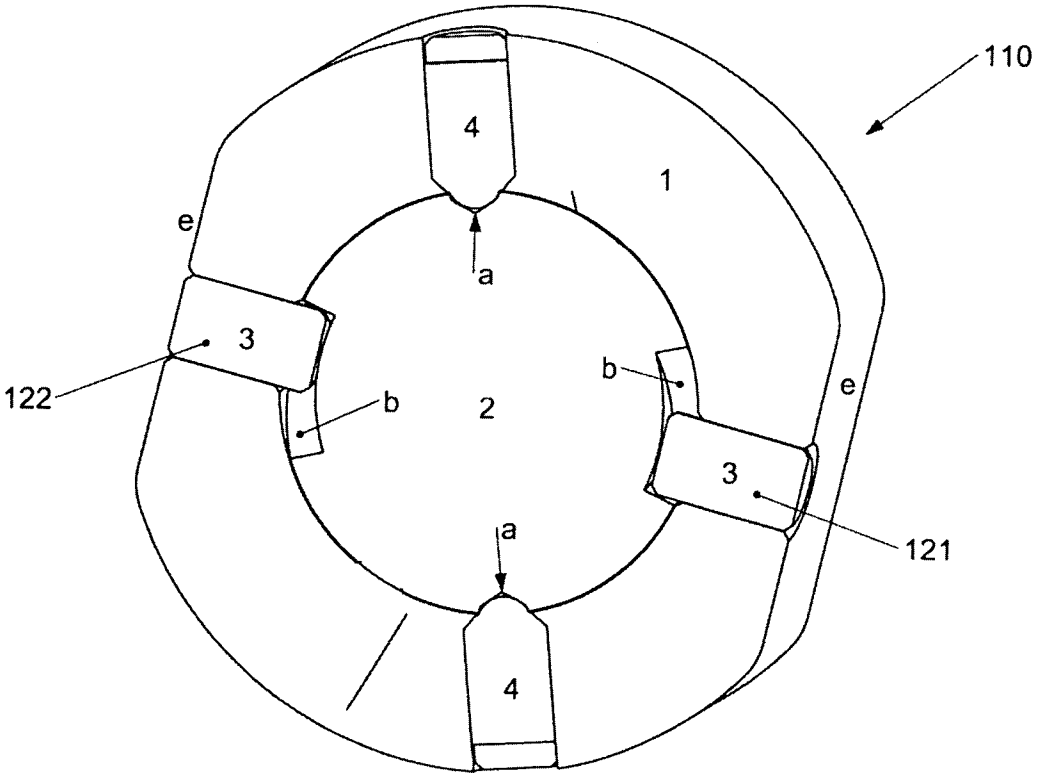
FIG. 11 is a sectional view of the retainer of FIG. 7 along a transverse plane orthogonal to the longitudinal axis with the shaft retracted.
Figure 12:
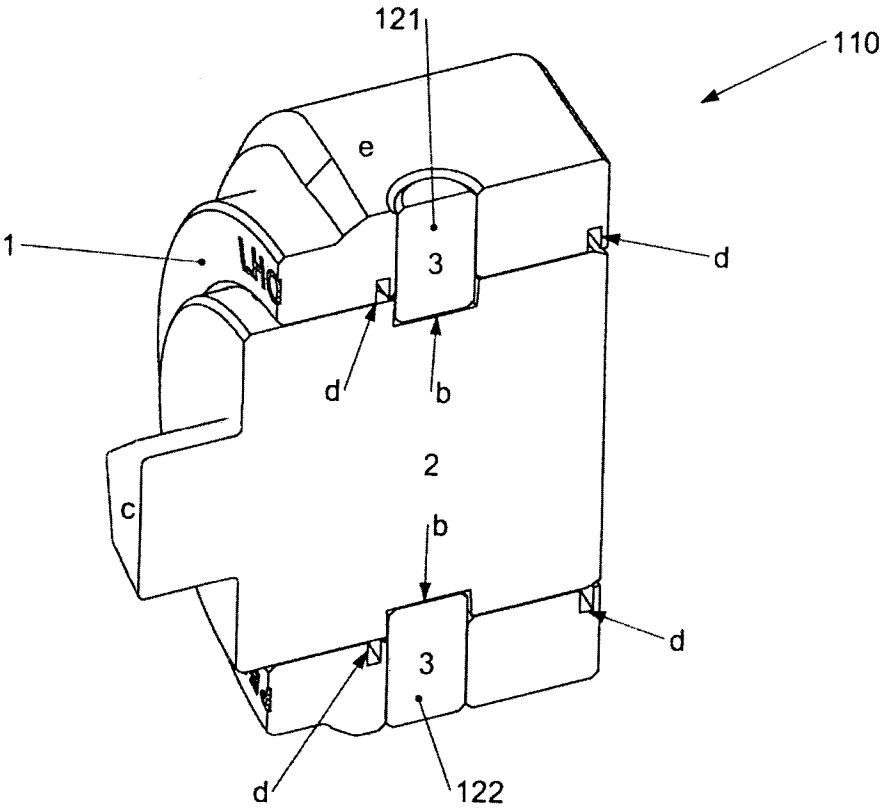
FIG. 12 is a sectional view of the retainer of FIG. 7 along a diametral plane containing the longitudinal axis passing through the flat sides of the housing with the shaft retracted.
Figure 13:
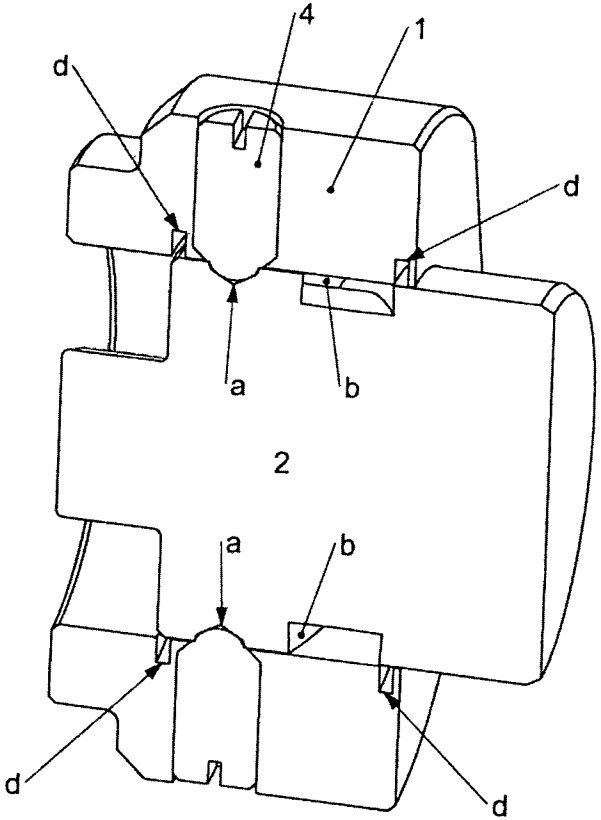
FIG. 13 is a sectional view of the retainer of FIG. 7 along a diametral plane passing through the round sides of the housing with the shaft extended.
Figure 14:
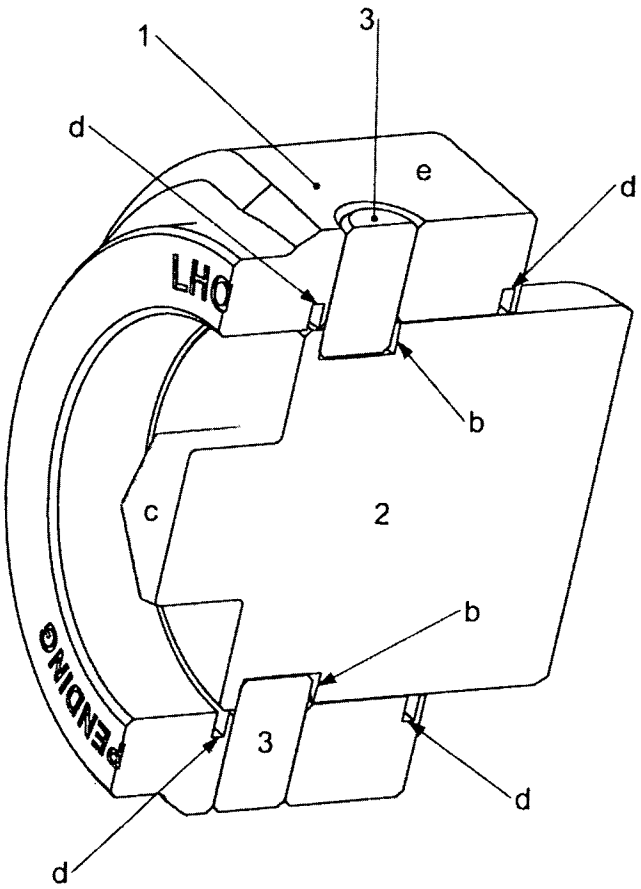
FIG. 14 is a sectional view of the retainer of FIG. 7 along a diametral plane passing through the flat sides of the housing with the shaft extended.

Advantageously, as can be seen in FIGS. 9 and 10, the shaft 114 has diametrically opposed helical recesses 117 and 118 which are slidably engaged by diametrically opposed radially extending locating pins 121 and 122 which are screwthreadedly mounted in the housing wall 119 and extend therethrough to engage in the helical grooves respectively as can be seen more clearly in FIGS. 9 to 13.

The retainer shaft 114 also includes longitudinally and angularly spaced dimples 126 and 127 which are adapted to be engaged by spring loaded locking pins 128 or 129 as the case may be for "locking" the shaft in either the protracted position or the extended position. The locking pins include a cylindrical screwthreaded housing 128*a* with a ball point pin 128*b* slidably mounted therein between a retracted position and an extended position in which the ball point protrudes beyond the inside end 128*c*. The ball point pin is biased to the extended position by a coil spring 128*d*.

Figure 15:
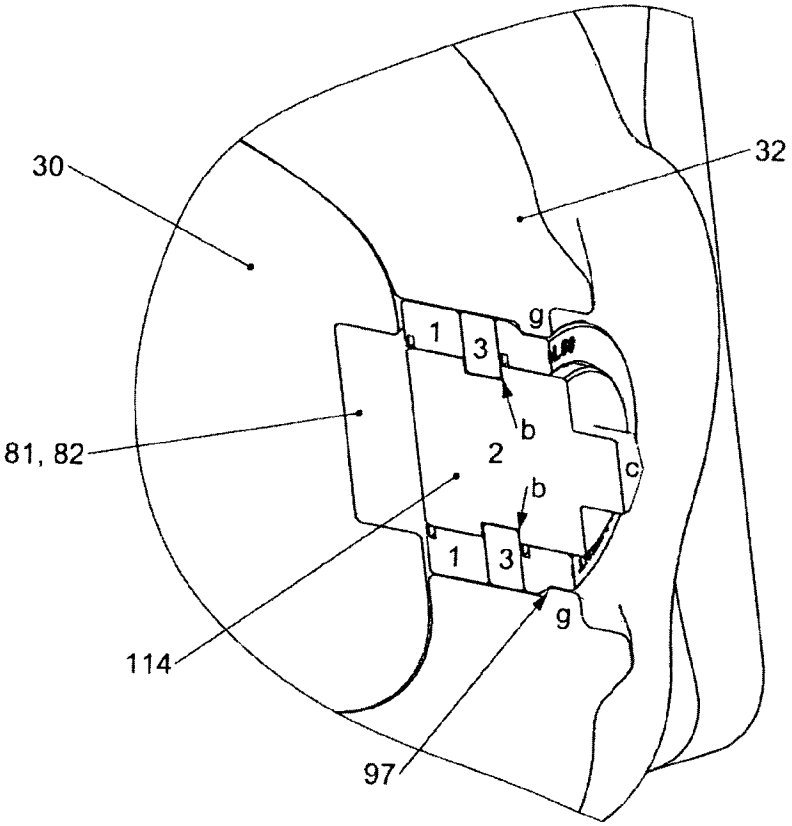
FIG. 15 is a sectional view of the retainer of FIG. 7 fitted to an adaptor with the adaptor mounted on a nose mount along a diametral plane passing through the flat sides of the housing with the retainer shaft retracted.
Figure 16:
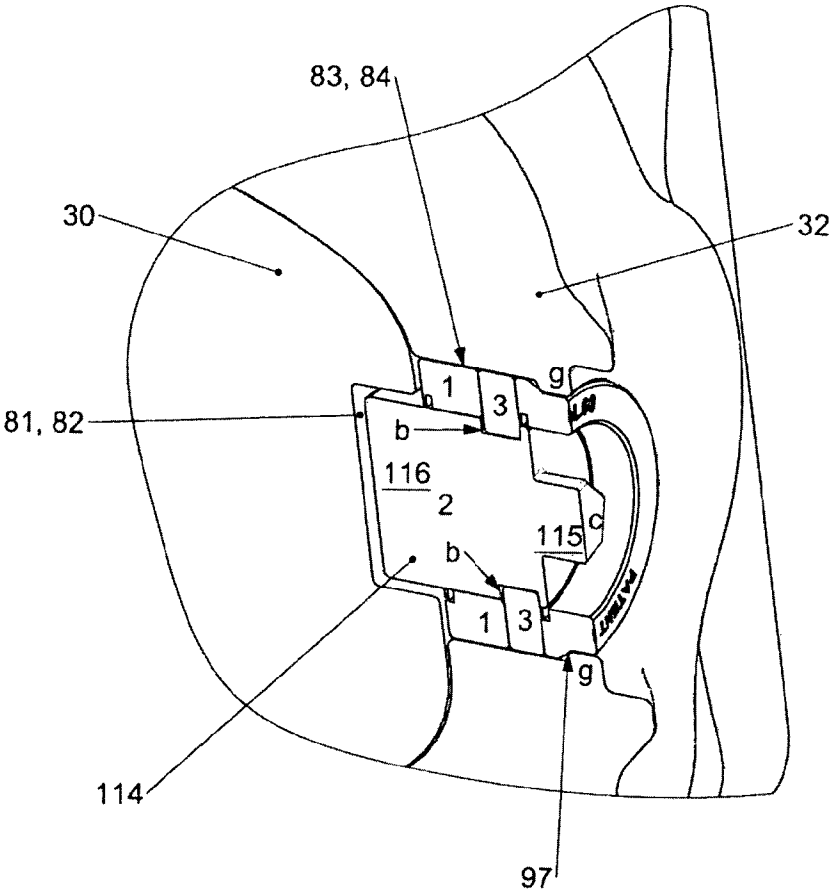
FIG. 16 is a sectional view of the retainer of FIG. 7 fitted to an adaptor with the adaptor mounted on a nose mount along a diametral plane passing through the flat sides of the housing with the retainer shaft extended.
Figure 17:
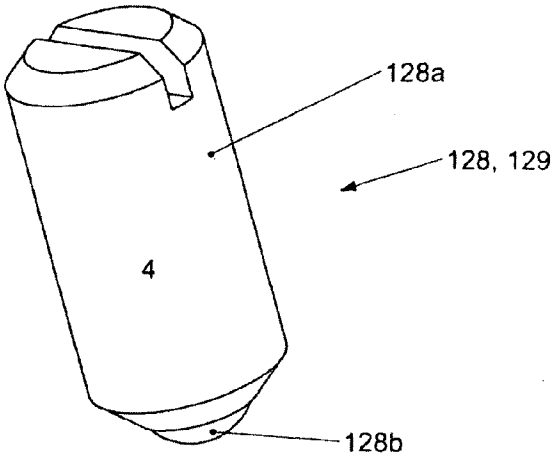
FIG. 17 is a pictorial representation of the pin and ball assembly component of the retainer of FIG. 7.
Figure 18:
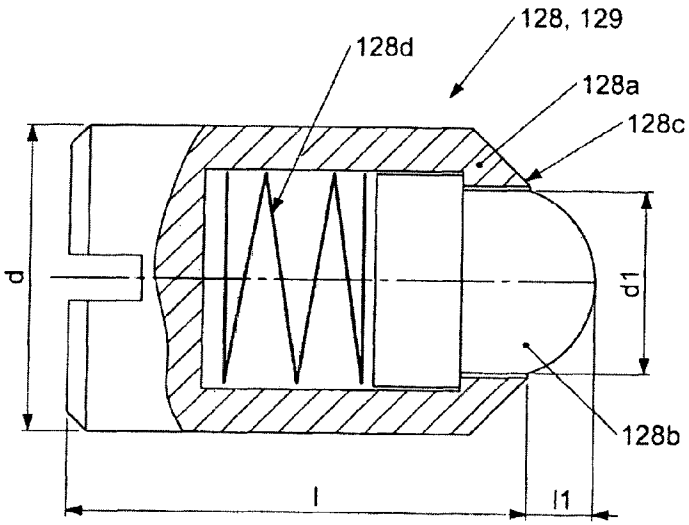
FIG. 18 is a sectional view of the pin and ball assembly of FIG. 17 along a longitudinal diametral plane.
Figure 19:
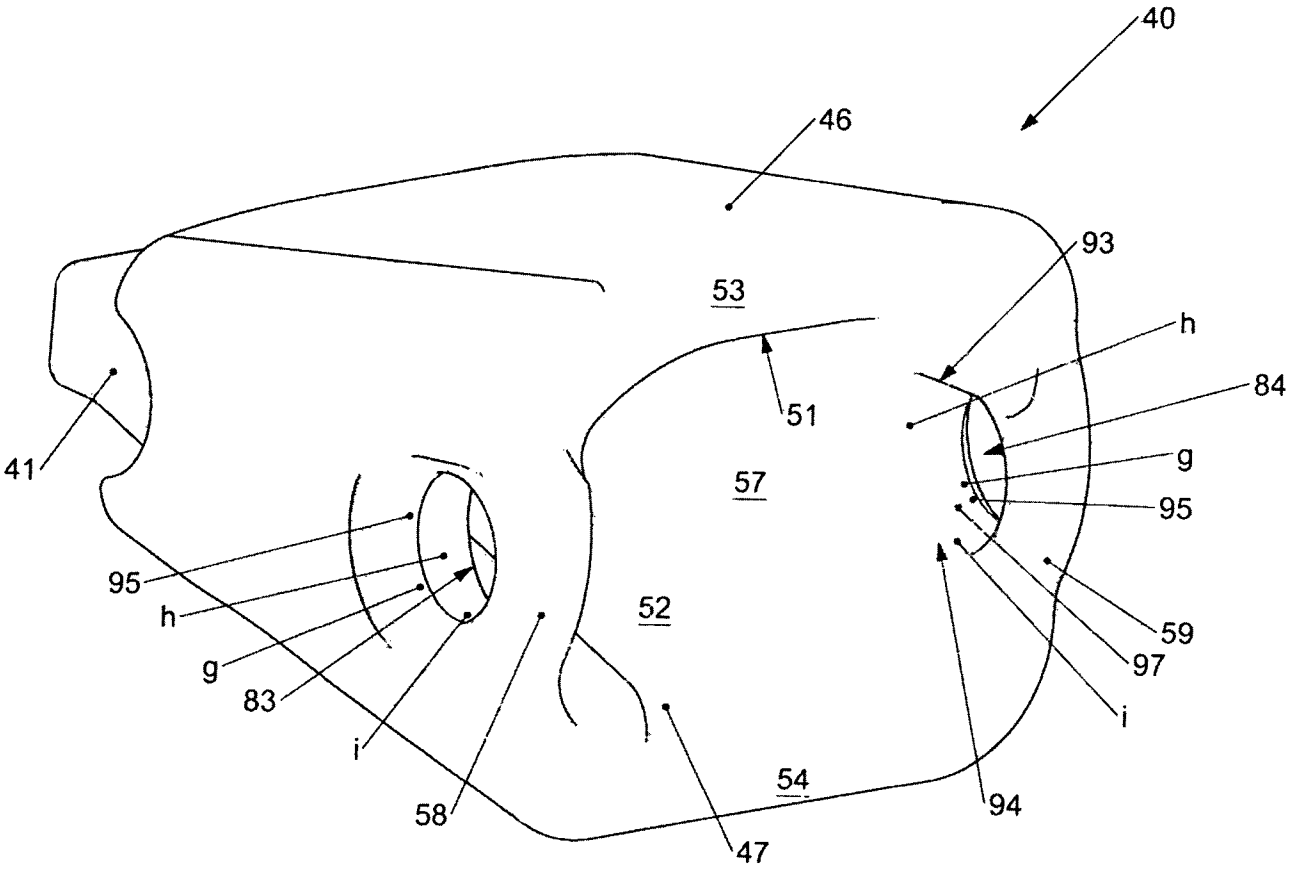
FIG. 19 is a pictorial representation of the adaptor shown in FIG. 4 without retainers fitted.
Figure 20:
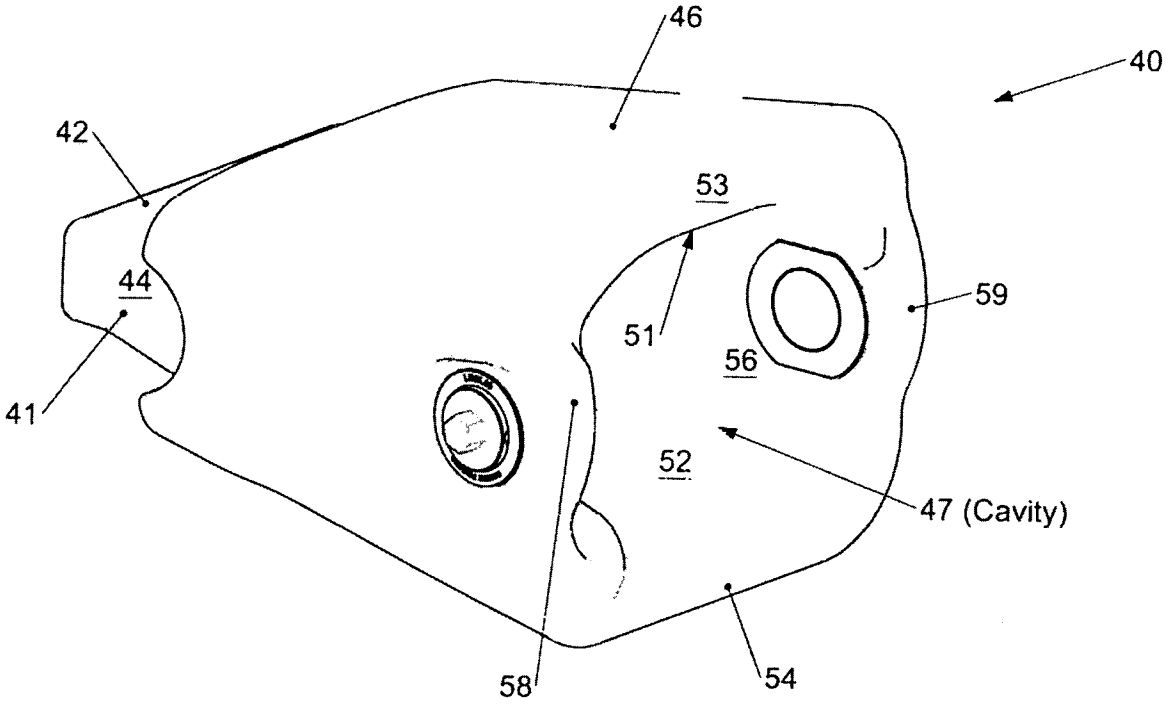
FIG. 20 is a pictorial representation of the adaptor of FIG. 10 from one side with the retainers of FIG. 7 fitted and the retainer shafts retracted.
Figure 21:
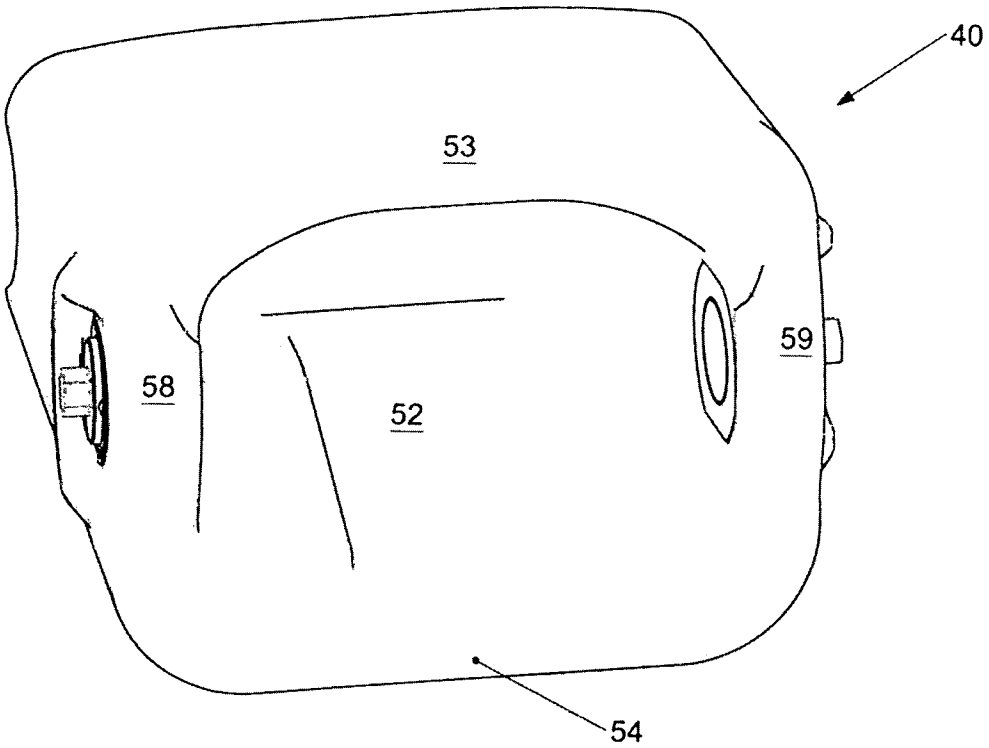
FIG. 21 is a pictorial representation of the adaptor of FIG. 10 from the rear with the retainers of FIG. 7 fitted and the retainer shafts retracted.
Figure 22:
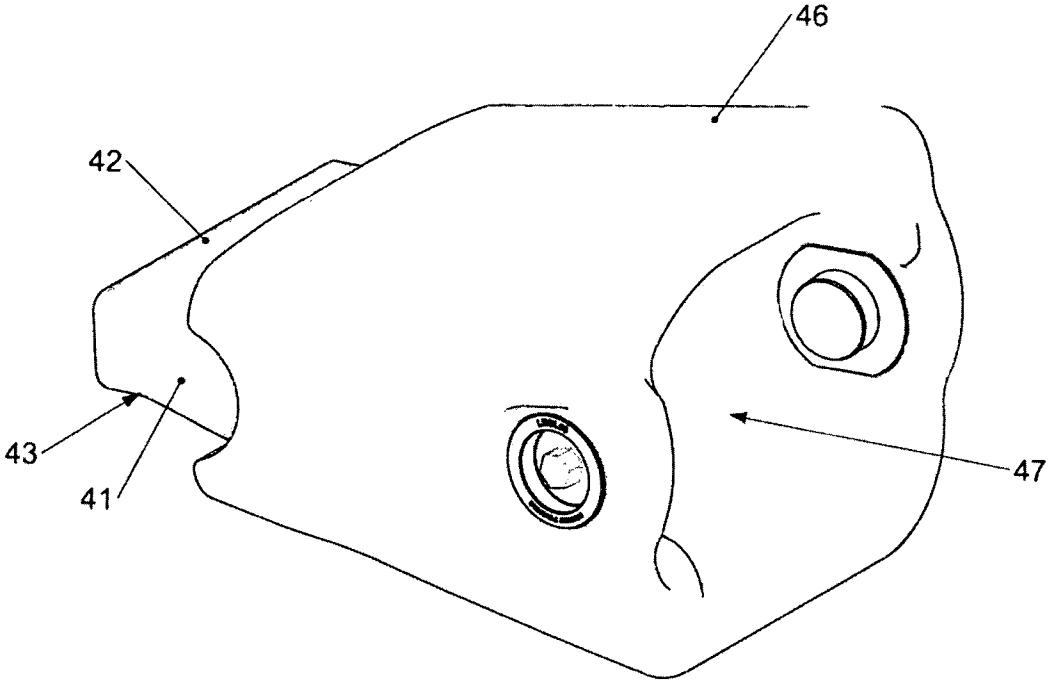
FIG. 22 is a pictorial representation of the adaptor of FIG. 10 from one side with the retainers of FIG. 7 fitted and the retainer shafts extended.
Figure 23:
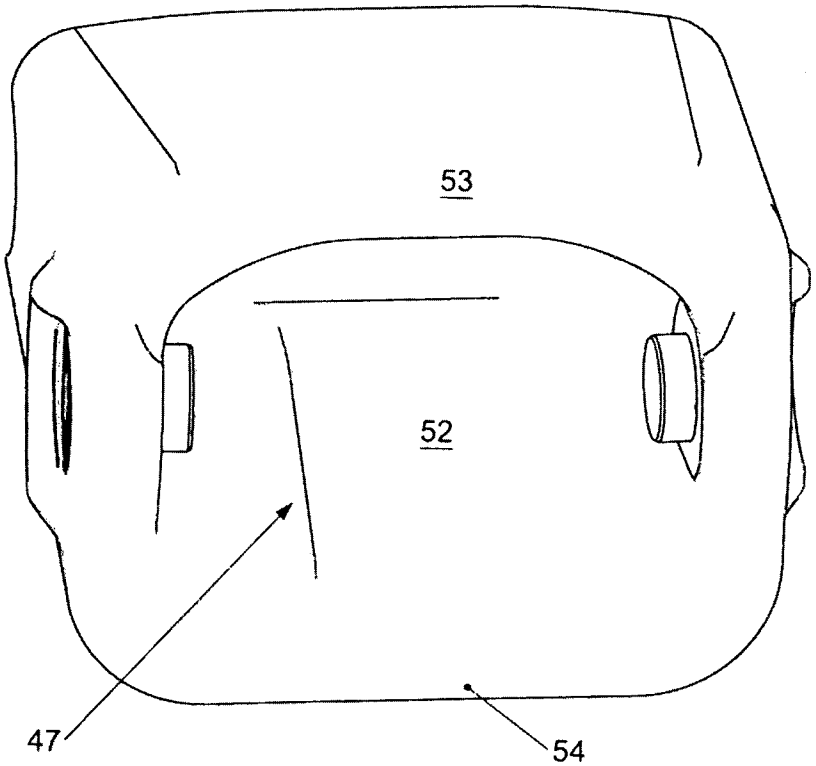
FIG. 23 is a pictorial representation of the adaptor of FIG. 10 from the rear with the retainers of FIG. 7 fitted and the retainer shafts extended.
Figure 24:
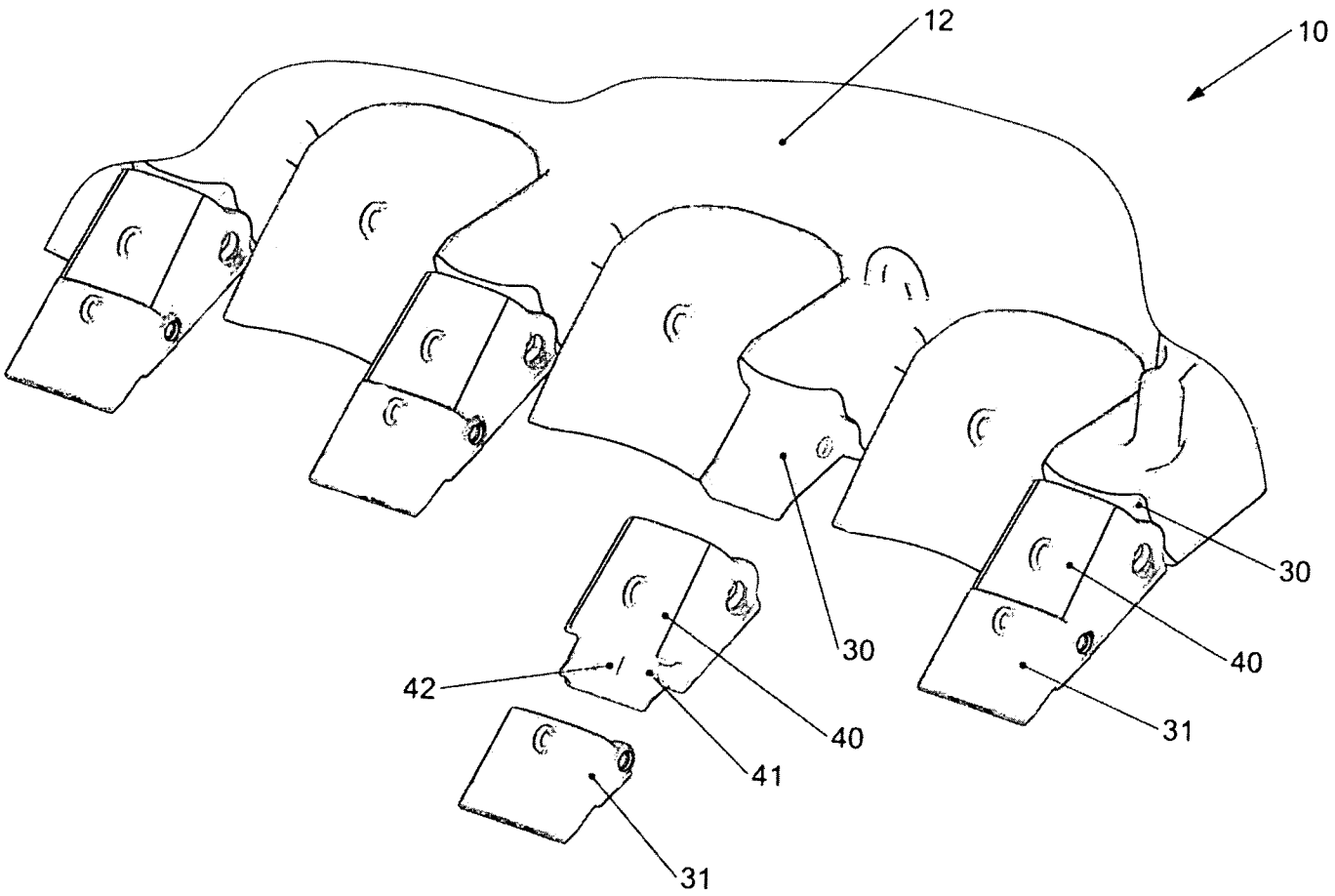
FIG. 24 is a pictorial representation of part of a bucket with nose mounts, adaptors and teeth fitted according to the invention.
Figure 25:
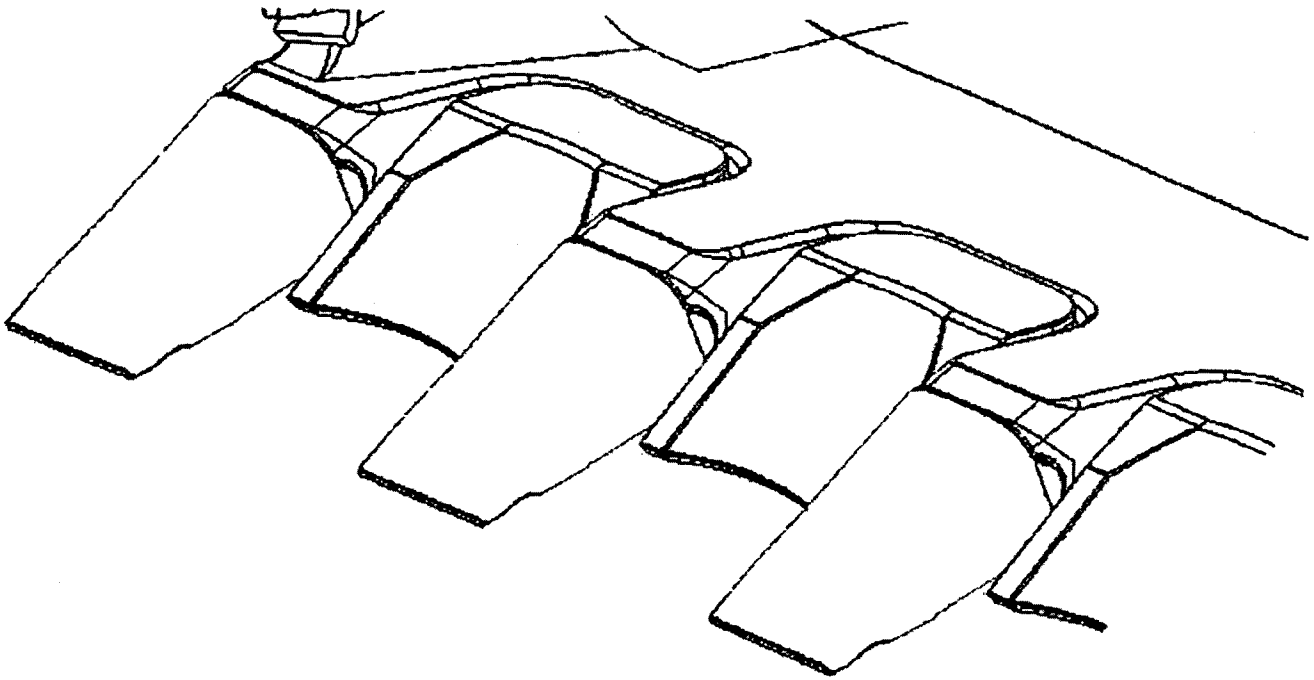
FIG. 25 is a pictorial representation of part of a bucket with nose mounts, adaptors and teeth fitted according to the invention.
Figure 26:
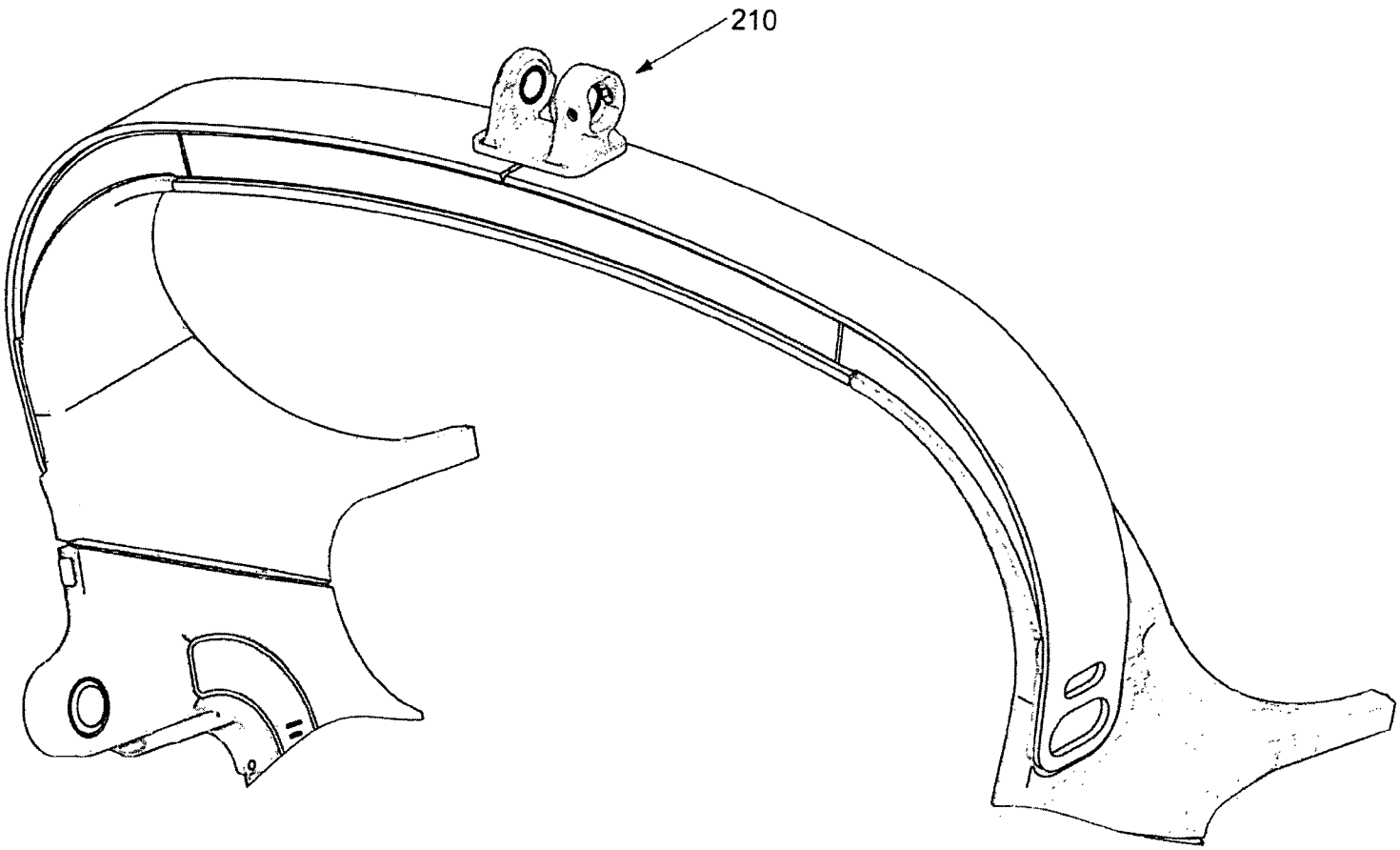
FIG. 26 is a pictorial representation of part of a dragline bucket from the front with an anchor bracket according to the invention mounted to the lifting arch.

As can be seen in FIGS. 15 and 16, a retaining device 110 is mounted in each of the opposed passages 83 and 84 of an adaptor 32 and is operative to secure the adaptor to the nose mount 30. Suitably, the passages 83 and 84 are generally cylindrical in form with opposed flat land portions 93 and 94 adapted to engage with complementary flat land portions 131 and 132 formed on the housing wall 119 to prevent relative rotation between the housing and adaptor. Also, the opposed side walls 58 and 59 of the adaptor include a flange portion 95 which extends partially across the holes or passages 83 and 84 thereby forming respective inwardly facing shoulders 97 against which a complementary shoulder 133 on the end of the housing wall 119 of the retaining device can engage whereby the spigot portion 134 of the housing protrudes through the passage 83 (or 84) to be flush with the outside of the adaptor wall and whereby shoulder 97 engaging with shoulder 133 stops the retainer device escaping from the passage 83 or 84 via its outer face end. Thus, the retainer device can be pushed into the passage 83 or 84 in a relatively tight fit or if desired can be secured by a suitable chemical product such as one known as "Locktite" or a silicone sealer or other suitable mechanism.

In use, an adaptor or tooth is fitted with opposed retaining devices as previously described by pushing them into the passages 83 and 84 respectively. While the shaft is in the protracted position, the tooth or adaptor can be fitted to a nose mount and then the shaft can be turned through an arc from the protracted position to the extended position by operation of a socket spanner on the hexagon head 115 thereby forcing the pin ends to locate in the blind passages 81 or 82 of the nose mount to secure the adaptor thereto. In the case where a tooth is being mounted to an adaptor or a nose mount the same operation is undertaken.

Figure 30:
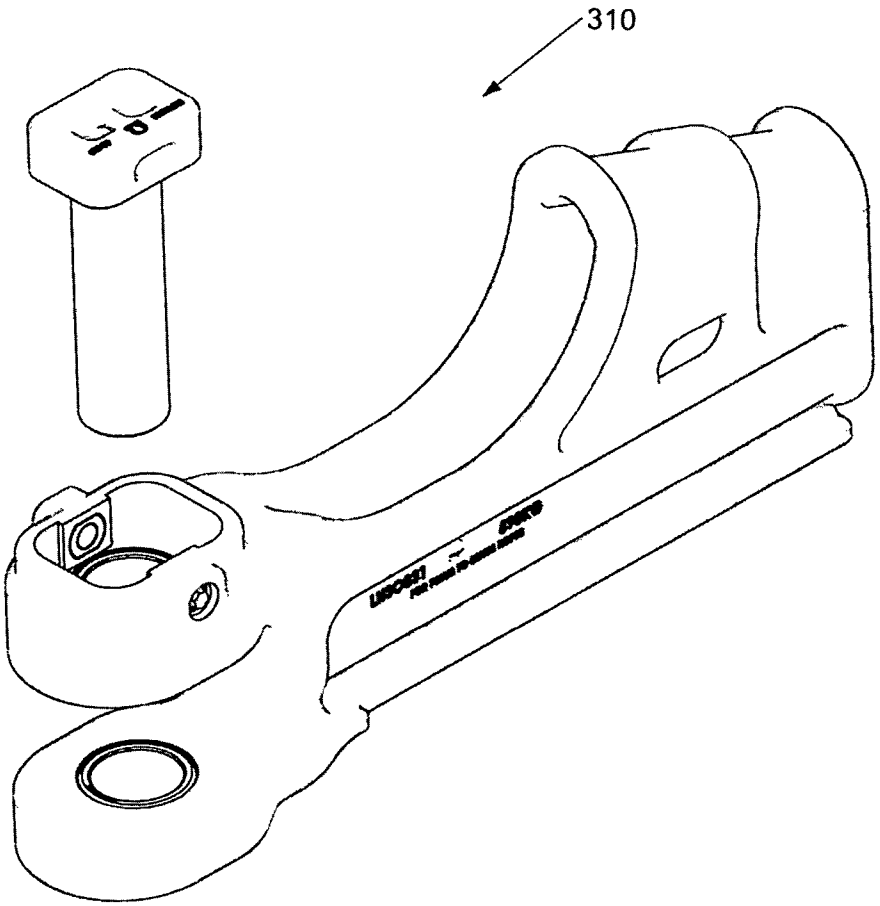
FIG. 30 is a pictorial representation of a drag socket assembly for use with a dragline bucket with two opposed retainers mounted therein and shown in the retracted position while the drag pin is shown in line for assembly.
Figure 31:
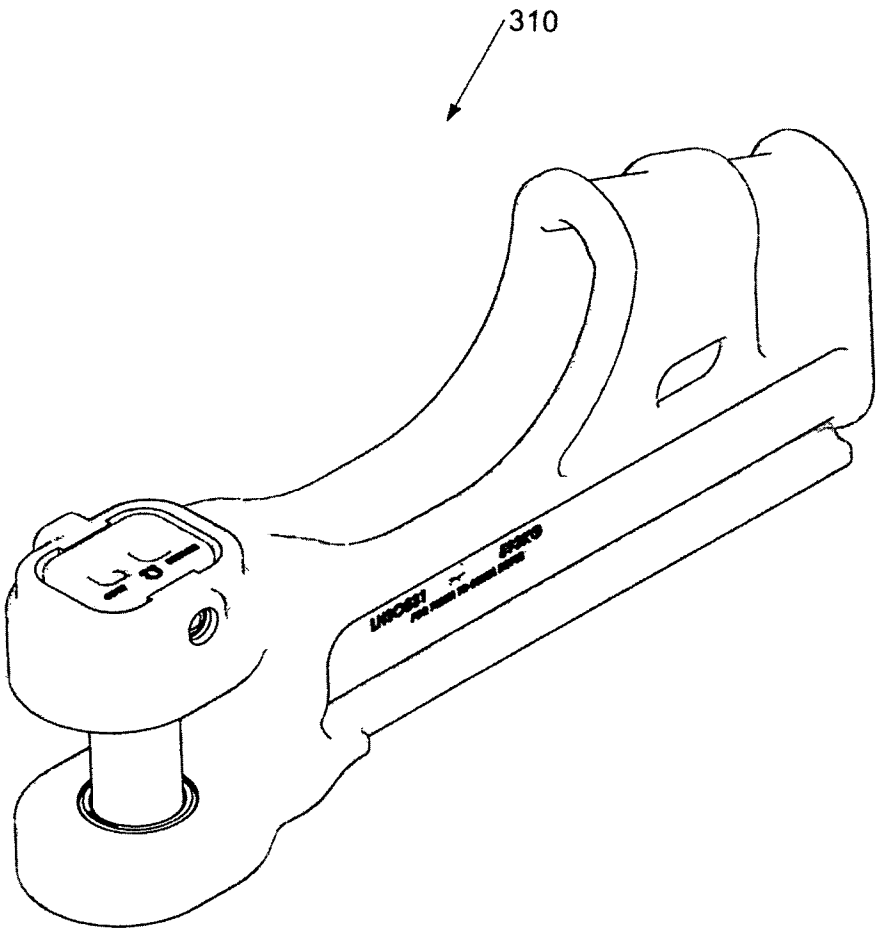
FIG. 31 is a another pictorial representation of the drag socket assembly of FIG. 30 with the drag pin assembled and secured by the two opposed retainers.
Figure 32:
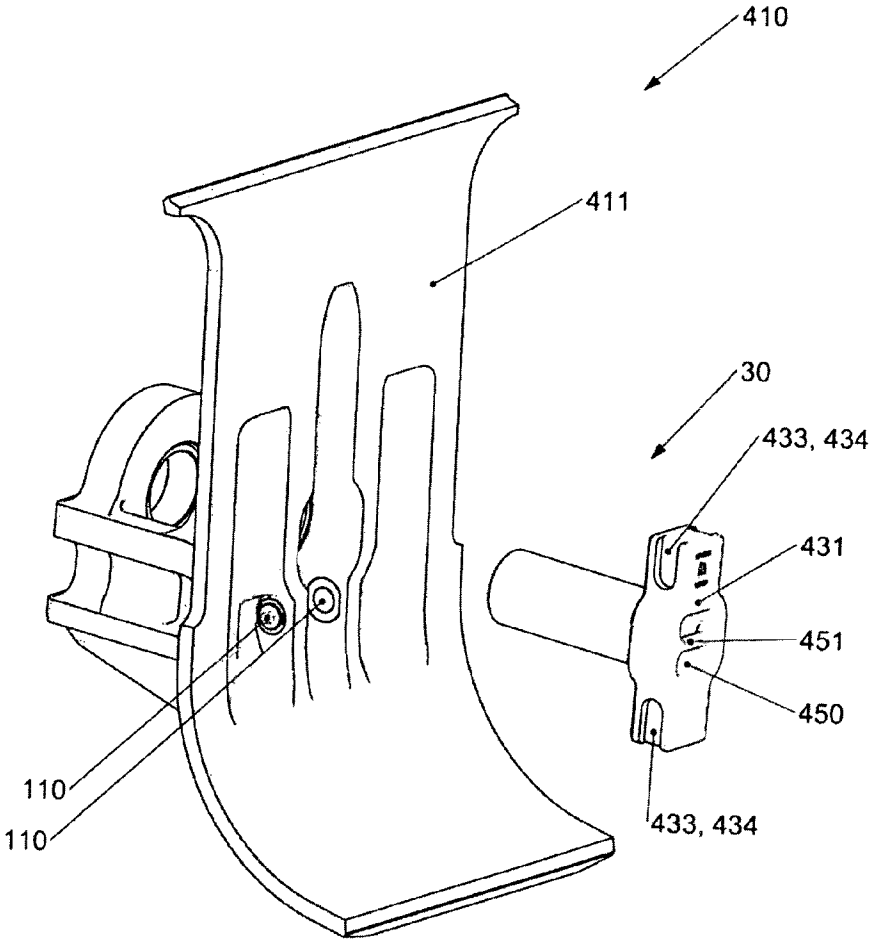
FIG. 32 is a pictorial representation of a trunnion bracket assembly for use with a dragline bucket with two opposed retainers mounted therein and shown in the retracted position while the trunnion pin is shown in line for assembly.
Figure 33:
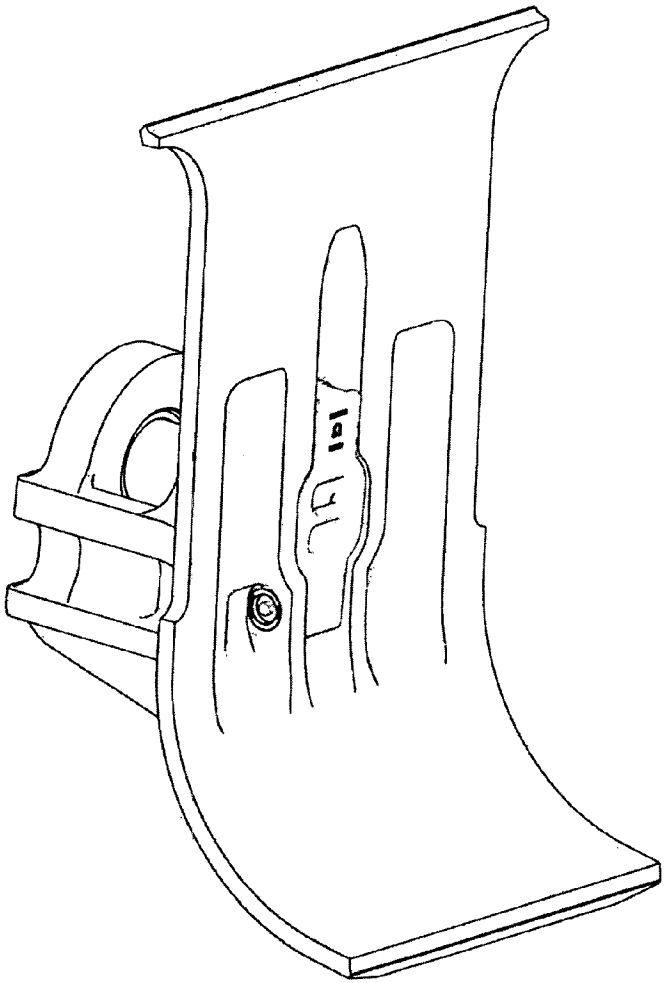
FIG. 33 is another pictorial representation of the trunnion bracket assembly of FIG. 32 with the trunnion pin assembled and secured by the two opposed retainers.

The anchor bracket assembly 210 illustrated in FIGS. 26 to 29, the drag socket assembly 310 illustrated in FIGS. 30 and 31, and the trunnion bracket assembly 410 illustrated in FIGS. 32 and 33 all operate in a similar manner when considered from the perspective of the connection between the pin and the other component. Consequently, the same numbers will be used to reference corresponding components where possible except prefaced by a "2", "3" or "4" as the case may be.

Figure 27:
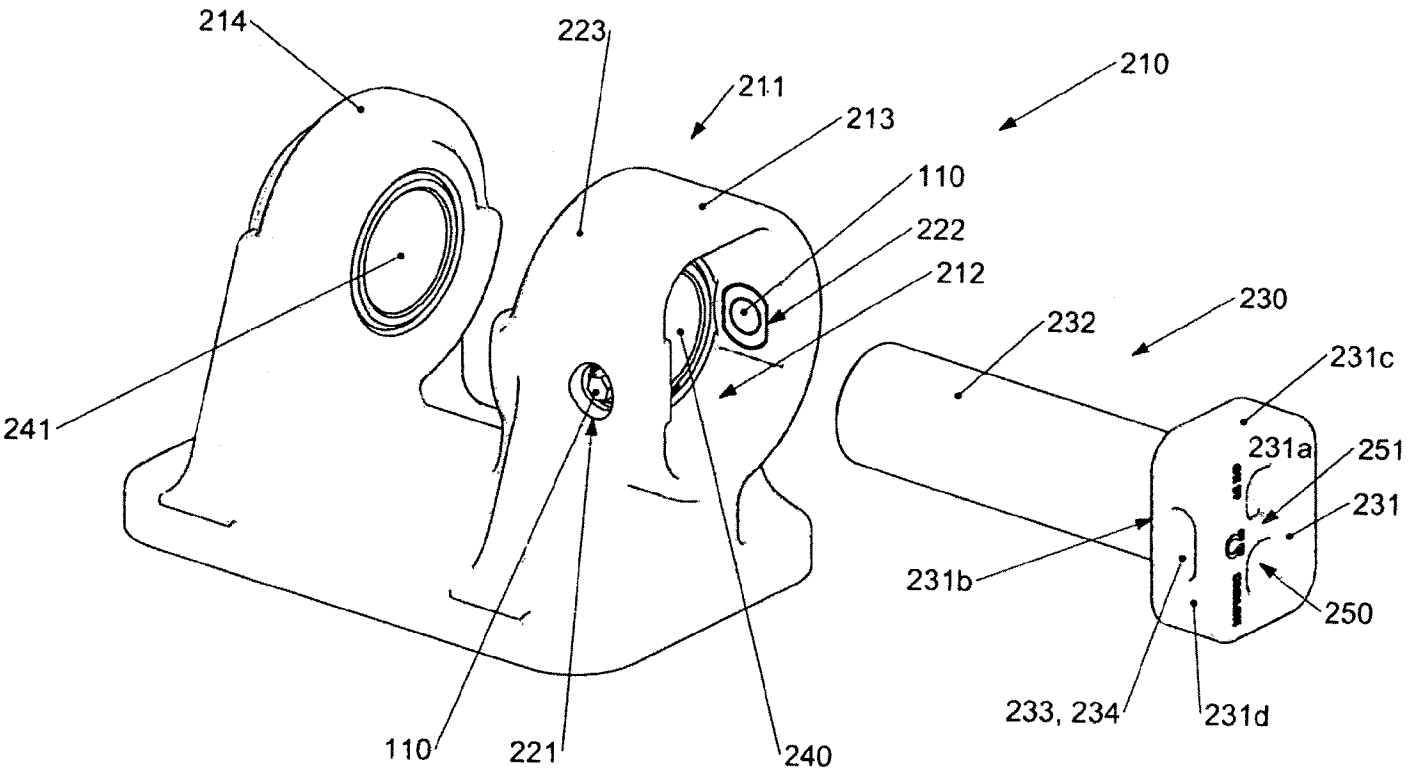
FIG. 27 is a pictorial representation of the anchor bracket assembly which is mounted to the lifting arch of the bucket of FIG. 26 with two opposed retainers mounted in the bracket and shown in the retracted position while the anchor pin is shown in line for assembly.
Figure 28:
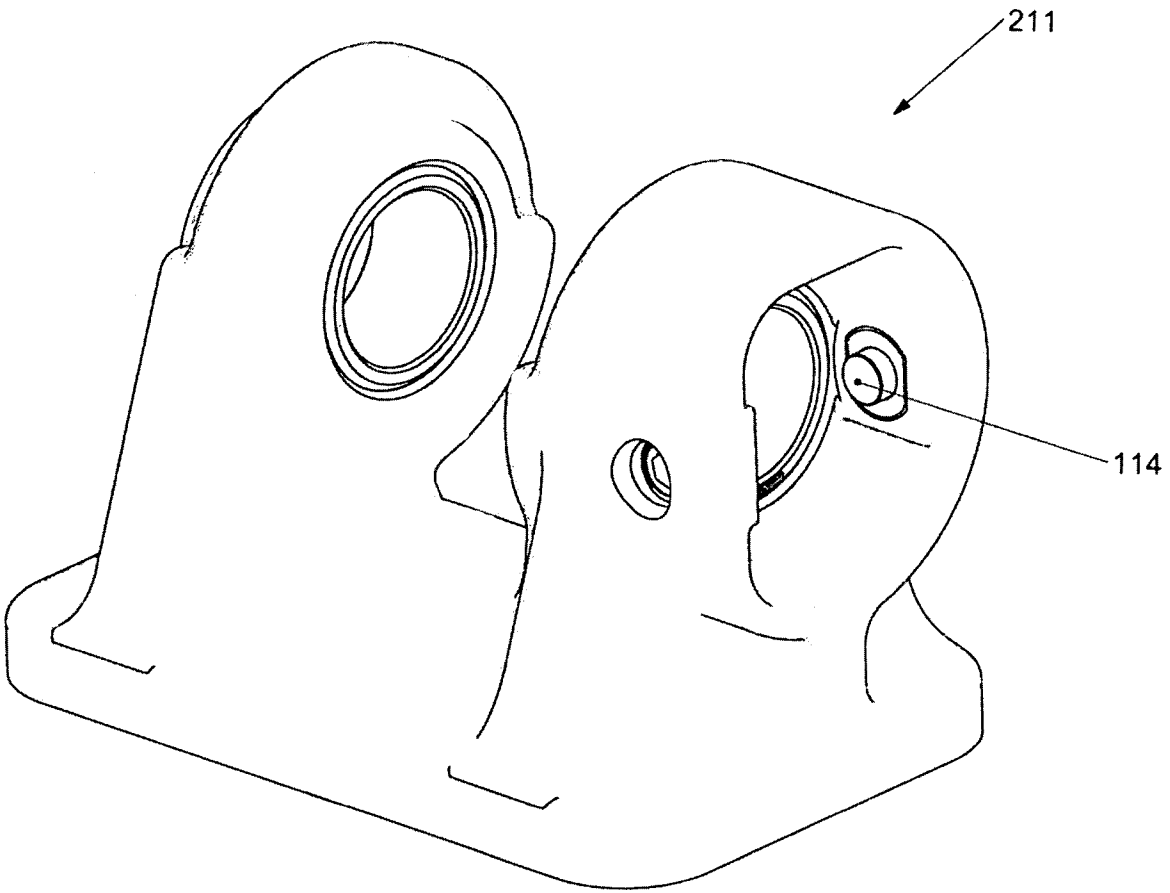
FIG. 28 is a another pictorial representation of the anchor bracket of FIG. 26 with the opposed retainers mounted in the bracket and shown in the extended position.
Figure 29:
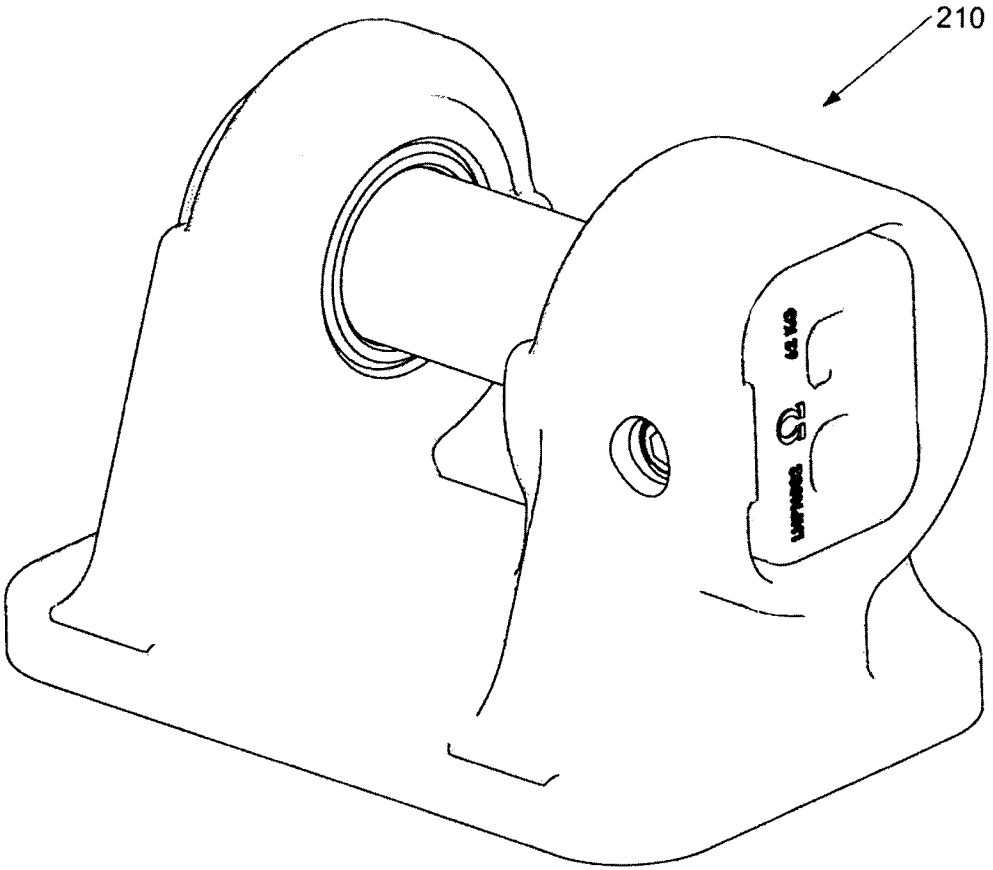
FIG. 29 is a pictorial representation of the anchor bracket assembly of FIG. 26 with the anchor pin assembled and secured by the two opposed retainers in the extended position.

As can be seen in FIG. 27, the anchor bracket (or block) 211 has a cavity or recess 212 formed in the end of the nearer one of the spaced apart pedestals 213 and 214, the cavity being sized and shaped to fit the head 216 of anchor pin 217 therein, the shape of the head being generally rectangular in lateral cross section and fitting in the complementary cavity with a predetermined clearance above and below the head to accommodate wear of the anchor pin. Opposed through passages 221 and 222 extend through the side wall 223 of the near pedestal opening at their inner ends to the cavity 212 and to the outer face of the pedestal at their outer ends. Suitably, the diameter of the passage over a substantial part of its length outwards from the cavity is larger than the remaining portion opening to the outer end, the different diameters being effective to form a shoulder within the cavity against which the respective retainers 110 bear in the same manner as described in relation to the tooth and adaptor.

The anchor pin 230 has a head 231 and a shaft 232 extending from the head. The head is generally in the form of a rectangular prism with an upper end face 231*a*, a lower end face 231*b* from which the shaft extends and four contiguous side faces forming an opposed pair of short faces 231*c* and an opposed pair of long faces 231*d*. Opposed aligned blind passages 233 and 234 extend into the head and open to the long faces for receiving therein the retaining shafts or pins 114 of the respective retainers 110 mounted in the pedestals 213 and 214 respectively when the anchor pin is assembled with the anchor bracket. The head also has a lifting valley 250 and bridge 251 across the valley which allows for connection of a lifting hook to assist with removal of the pin from the bracket.

In use, the retainers are fitted in their respective cavities 221 and 222 with the retainer shafts 114 fully retracted so that they do not protrude into the pin head cavity 212 and then the anchor pin 232 is pushed into the anchor bracket so that the anchor shaft 232 rests in the journals 240 and 241 and the head is within the cavity 212. In that position, the recesses 233 and 2344 will be aligned with the retainer shafts 114 whereupon the retainer shafts may be rotated through the appropriate arc to force them into engagement with the recesses 233 and 244 so as to secure the turned anchor pin in the anchor bracket, as will be understood from FIG. 28. In this form of the invention, it will be appreciated that the blind holes or recesses 233 and 234 are elongate in the up and down direction or slightly obround so as to accommodate wear of the anchor pin within the journals 240 and 241.

The drag socket assembly 310 illustrated in FIGS. 30 and 31 works in the same manner as the anchor pin and consequently the foregoing description applies with the same numbers but prefaced by a "3" instead of a "2".

The trunnion bracket assembly 410 illustrated in FIGS. 32 and 33 works in the same manner as the anchor pin and consequently the foregoing description applies with the same numbers but prefaced by a "4" instead of a "2" except that the head 431 of the trunnion pin 430 is different from the head of the anchor pin in order to accommodate the retainers being offset from the axis of the pin which allows a bigger lifting valley 450 and bridge 451 to be provided in the head. Offsetting of the retainers from the axis also allows the head to be bigger.

It will appreciated that the present invention allows for quick and easy replacement of wear parts especially ground engaging tools such as teeth and adaptors and that such items can be provided with the retaining devices already fitted thereto and held in the passages by silicone glue or the like.

While the foregoing description has been given by way of illustrative example of the invention, it will be understood that the invention may be embodied in many other forms and all such forms are deemed to fall within the broad scope and ambit of the invention as defined by the appended claims.

The invention claimed is:

1. A retainer for retaining a wear part on a mount, the retainer being adapted to be mounted in the wear part and to be actuated to secure the wear part to the mount, the retainer including:

a housing with a bore therethrough having an inner end and an outer end;

a shaft mounted in said bore, said shaft including connection means accessible from the outer end of said housing for connection of a tool thereto for rotating said shaft relative to said housing;

coupling means coupling said shaft to said housing and arranged to cause movement of said shaft along said bore in one direction upon rotation thereof relative to said housing in one direction between a retracted position and an extended position and movement in the opposite direction along said bore upon rotation in the opposite direction between an extended position and a retracted position;

wherein the components are arranged such that when in the extended position the outer end of the shaft is substantially within the bore of the housing and the inner end protrudes inwards beyond the bore of the housing, and when in the retracted position, the inner end of the shaft is substantially within the bore;

said coupling means including a pair of opposed helical grooves or channels formed in said shaft and opening to the outer cylindrical face and complementary pins mounted in said housing so as to secure said shaft in said housing to form a singular unit, said complementary pins being arranged to engage with the grooves or channels so as to permit the shaft to rotate relative thereto while moving along the bore between the retracted and extended positions; and wherein the coupling means includes spring-loaded locking pins or balls mounted in bores through the housing and arranged to cooperate with complementary dimples in said shaft so as to prevent movement of the shaft beyond a predetermined extended position.

2. A retainer according to claim 1, wherein the size of the housing is selected so that the inner end of the housing is flush with the inner face of the cavity of the wear part to which it is to be fitted.

3. A retainer according to claim 1, wherein the housing and the shaft are selected such that when in the extended position a sufficient portion of the shaft is maintained in the housing to transmit load applied to the shaft by the housing to the mount with which it is intended to engage.

4. A retainer according to claim 1, wherein said connection means is a hexagonal shaped head adapted to be engaged by a socket spanner or a hexagonal shaped recess adapted to be engaged by an Allen key.

5. A retainer according to claim 1, wherein the housing has a generally cylindrical outer face with opposed flat land portions defining opposite chords of the housing, the lands being adapted to engage with complementary lands provided in the passage in the wear part in which the retainer is to be mounted.

6. A retainer according to claim 1, wherein the housing includes a spigot portion defining a shoulder adapted to engage with a complementary shoulder provided in the passage in the wear part in which the retainer is to be mounted.

7. A retainer according to claim 1, wherein said complementary pins are screwthreadedly mounted in said housing.

* * * * *